US005427880A

United States Patent [19]

Tamura et al.

[11] Patent Number: 5,427,880

[45] Date of Patent: Jun. 27, 1995

[54] ELECTROPHOTOGRAPHIC PHOTOCONDUCTOR

[75] Inventors: Hiroshi Tamura, Susono; Toshio Fukagai, Numazu, both of Japan

[73] Assignee: Ricoh Company, Ltd., Tokyo, Japan

[21] Appl. No.: 189,605

[22] Filed: Feb. 1, 1994

[30] Foreign Application Priority Data

Feb. 1, 1993 [JP] Japan ..... 5-036152

[51] Int. Cl.[6] ..... G03G 5/047; G03G 5/09

[52] U.S. Cl. ..... 430/59; 430/83

[58] Field of Search ..... 430/59, 83

[56] References Cited

U.S. PATENT DOCUMENTS

| | | | |
|---|---|---|---|
| 4,556,623 | 12/1985 | Tamura et al. | 430/83 |
| 4,806,443 | 2/1989 | Yanus et al. | 430/59 X |
| 4,959,288 | 9/1990 | Ong et al. | 430/59 |
| 5,030,532 | 7/1991 | Limburg et al. | 430/59 X |
| 5,153,087 | 10/1992 | Tamura et al. | 430/64 |
| 5,322,753 | 6/1994 | Tamura et al. | 430/59 |

FOREIGN PATENT DOCUMENTS

| | | | |
|---|---|---|---|
| 134457 | 5/1989 | Japan | 430/59 |
| 314251 | 12/1989 | Japan | 430/59 |

*Primary Examiner*—Roland Martin

*Attorney, Agent, or Firm*—Oblon, Spivak, McClelland, Maier, & Neustadt

[57] ABSTRACT

An electrophotographic photoconductor composed of an electroconductive substrate and a photoconductive layer formed thereon, containing an interpenetrating polymer network prepared by polymerizing a composition composed of a binder resin and at least one polymerizable carbon-carbon double-bond-containing charge transporting monomer selected from the group consisting of monomers of formulas (I), (II) and (III) by the application of light or heat thereto:

(I)

(II)

(III)

19 Claims, No Drawings

ELECTROPHOTOGRAPHIC PHOTOCONDUCTOR

BACKGROUND OF THE INVENTION

1. Field of the Invention

The present invention relates to an electrophotographic photoconductor comprising an electroconductive substrate, and a photoconductive layer formed on the substrate, which has sufficient hardness and mechanical strength, and high photosensitivity and durability.

2. Discussion of Background

Recently, organic photoconductors (OPC) are widely used in copying machines and printers. Such organic photoconductors comprise an electroconductive substrate and a photoconductive layer. The photoconductive layer may comprise a charge generation layer (CGL) and a charge transport layer (CTL) which are successively overlaid on the substrate. The CTL of the conventional photoconductor is in the form of a film which comprises a low-molecular-weight charge transporting material (CTM) which is dispersed in a binder resin in a certain concentration. The addition of the charge transporting material to the binder resin causes deterioration of the mechanical strength of the binder resin itself, and therefore, the CTL is fragile and has a low tensile strength. It is considered that the above-mentioned deterioration of the mechanical strength of the binder resin in the CTL causes some problems of the photoconductor, such as wear, flaw, peeling, and crack.

It is proposed to employ a high-molecular-weight material as the charge transporting material in the CTL. For instance, polymers such as polyvinylcarbazole, polyvinyl anthracene and polyvinyl pyrene reported by M. Stolka in J. POLYM. SCI. VOL. 21, 969; and a vinyl polymer of hydrazone described in '89 JAPAN HARD COPY p. 67 are proposed to use as charge transporting materials in the CTL. However, a film of the CTL is still fragile, and sufficient mechanical strength cannot be obtained. In addition, the above-mentioned high-molecular-weight materials have shortcomings in the sensitivity and the mobility of hole in practice, which induces high residual potential and decreases the durability of a photoconductor.

To solve the aforementioned problems of the CTL, it is proposed that the CTL is formed by previously dispersing a charge transporting material in a binder resin and then curing the binder resin containing the charge transporting material. In this proposal, however, the content of the charge transporting material in the binder resin is as high as 30 to 50 wt. %, so that a sufficient curing reaction is not carried out and the charge transporting material easily falls off the binder resin. The problem of wear of the photoconductor has not yet been solved.

Furthermore, it has also been proposed to add to the photoconductive layer a silicon-containing polymer as disclosed in Japanese Laid-Open Patent Applications 61-219049 and 62-205357; a fluorine-containing polymer as disclosed in Japanese Laid-Open Patent Applications 50-23231, 61-116362, 61-204633 and 61-270768; finely-divided particles of silicone resins and fluorine-containing resins as disclosed in Japanese Laid-Open Patent Application 63-65449; and finely-divided particles of melamine resins as disclosed in Japanese Laid-Open Patent Application 60-177349. However, the compatibility of these additives with the charge transporting material and the binder resin is poor, so that the charge transport layer becomes opaque because of phase separation, accordingly, the electrical characteristics of the charge transport layer is impaired.

SUMMARY OF THE INVENTION

Accordingly, an object of the present invention is to provide an electrophotographic photoconductor with improved hardness and mechanical strength, and high photosensitivity and durability.

The above-mentioned object of the present invention can be achieved by an electrophotographic photoconductor comprising an electroconductive substrate and a photoconductive layer formed thereon, comprising an interpenetrating polymer network prepared by polymerizing a composition comprising a binder resin and at least one polymerizable carbon-carbon double-bond-containing charge transporting monomer selected from the group consisting of monomers of formulas (I), (II) and (III) by the application of light or heat thereto:

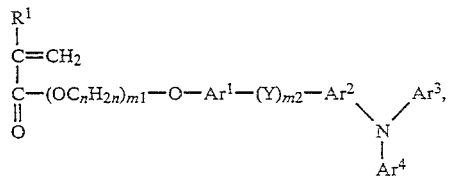

(I)

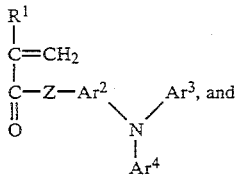

(II)

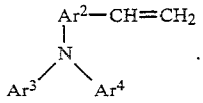

(III)

wherein $R^1$ is hydrogen or methyl group; $Ar^1$ and $Ar^2$ each is a bivalent aromatic hydrocarbon group which may have a substituent such as hydrogen, a halogen such as fluorine, chlorine, bromine or iodine, or a straight-chain or branched alkyl group having 1 to 4 carbon atoms which may have a substituent such as fluorine, cyano group or phenyl group; $Ar^3$ and $Ar^4$ each is a monovalent aromatic hydrocarbon group which may have a substituent such as hydrogen, a halogen such as fluorine, chlorine, bromine or iodine, or a straight-chain or branched alkyl group having 1 to 4 carbon atoms which may have a substituent such as fluorine, cyano group or phenyl group; Y is $-C_nH_{2n}-$, $-CH=CH-$, or $-Car^1=CH-$; Z is $-O-$, $-OC_nH_{2n}-$, or $-OC_nH_{2n}O-$; n is an integer from 1 to 10; and m1 and m2 is an integer of 0 or 1.

DETAILED DESCRIPTION OF THE PREFERRED EMBODIMENTS

A photoconductive layer of an electrophotographic photoconductor according to the present invention comprises an interpenetrating polymer network prepared by polymerizing a composition comprising a binder resin and at least one polymerizable carbon-carbon double-bond-containing charge transporting monomer selected from the group consisting of monomers of formulas (I), (II) and (III) by the application of light or heat thereto:

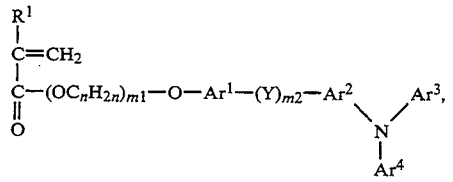

(I)

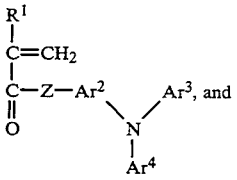

(II)

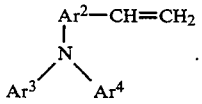

(III)

wherein $R^1$ is hydrogen or methyl group; $Ar^1$ and $Ar^2$ each is a bivalent aromatic hydrocarbon group which may have a substituent such as hydrogen, a halogen such as fluorine, chlorine, bromine or iodine, or a straight-chain or branched alkyl group having 1 to 4 carbon atoms which may have a substituent such as fluorine, cyano group or phenyl group; $Ar^3$ and $Ar^4$ each is a monovalent aromatic hydrocarbon group which may have a substituent such as hydrogen, a halogen such as fluorine, chlorine, bromine or iodine, or a straight-chain or branched alkyl group having 1 to 4 carbon atoms which may have a substituent such as fluorine, cyano group or phenyl group; Y is $-C_nH_{2n}-$, $-CH=CH-$, or $-CAr^1-CH-$; Z is $-O-$, $-OC_nH_{2n}-$, or $-OC_nH_{2n}O-$; n is an integer from 1 to 10; and m1 and m2 is an integer of 0 or 1.

Specific examples of the alkyl group serving as a substituent of $Ar^1$, $Ar^2$, $Ar^3$ and $Ar^4$ include methyl group, ethyl group, n-propyl group, isopropyl group, n-butyl group, isobutyl group, sec-butyl group, tert-butyl group, trifluoromethyl group, cyanoethyl group and benzyl group.

The polymerizable carbon-carbon double-bond-containing monomers represented by formulas (I), (II) and (III) have a triphenylamine skeleton which is regarded as a hopping site of a charge carrier, so that they have excellent charge carrier transporting characteristics. Each of these monomers can polymerize in the presence of a polymerization initiator of a radical or ion to form a high-molecular weight compound.

When the charge transport layer of the laminated type photoconductor is prepared by polymerizing the chare transporting monomer of formula (I), (II) or (III) without using any binder resin, sufficient mechanical strength of the charge transport layer cannot be obtained. In addition, when a composition comprising a high-molecular charge transporting material obtained by polymerizing the charge transporting monomer of formula (I), (II) or (III), and the binder resin is coated to prepare the charge transport layer, the obtained charge transport layer becomes opaque because the compatibility of the high-molecular charge transporting material with the binder resin is poor. Therefore, in the present invention, the photoconductive layer is prepared by coating a composition uniformly comprising the charge transporting monomer of formula (I), (II) or (III) and the binder resin, and polymerizing the composition by the application of heat or light thereto to form an interpenetrating polymer network, so that a transparent uniform photoconductive layer is obtained.

Before the polymerization of the charge transporting monomer, a solid solution comprising the charge transporting monomer and the binder resin constitutes a film for the photoconductive layer, so that the charge transporting monomer is stabilized in the solid solution. When the above-mentioned film is heated to 60° C. or more by the application of heat or light energy thereto, the charge transporting monomer is activated, and a radical serving as an active seed for initiating the polymerization is generated and transported through the activated solid solution. Thus, the charge transporting monomer is polymerized. The degree of polymerization is presumed to be 20 or less. While the radical serving as the active seed for initiating the polymerization is transported in succession through the binder resin, the binder resin is activated. Thus, the activated binder resin is linked with the charge transporting monomer to form an interpenetrating polymer network. Such a phenomenon can be confirmed by the increase of the pencil hardness of the obtained film about two orders, and the increase of the amount of a gel component which is soluble in dichloroethane after polymerization.

The mobility of the high-molecular charge transporting material such as polyvinyl carbazole or a polyacrylic charge transporting material reported by M. Stolka et al is slower than that of the low-molecular resin-dispersion type charge transporting material. In addition, the mobility of the above-mentioned high-molecular charge transporting materials considerably depends on the strength of an electrical field applied thereto. This is ascribed to slow-moving molecular motion of the high-molecular compound.

In the present invention, since the charge transporting monomer of formula (I), (II) or (III) is polymerized in the solid solution as previously described, the obtained polymer of the charge transporting monomers and the binder resin get tangled together to form an interpenetrating polymer network film. As a result, the charge transporting material is prevented from falling off the photoconductive layer, and the hardness of the photoconductive layer is increased to improve the wear resistance thereof. Furthermore, the degree of polymerization of the charge transporting monomer can be restrained to a certain extent, so that the molecular motion of the obtained charge transporting material at the hopping site of electrical charges is active similar to the molecular motion of the low-molecular charge transporting material. Consequently, the electrical characteristics of the obtained photoconductor is not impaired.

Specific examples of the polymerizable carbon-carbon double-bond-containing charge transporting monomer which is used to form the interpenetrating polymer network together with the binder resin matrix are as follows: (1) Carbon-carbon double-bond-containing monomers of formula (I):

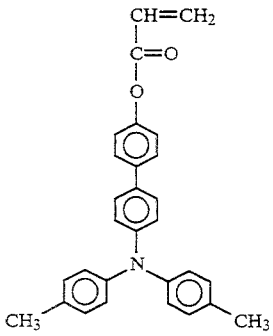
No. 1
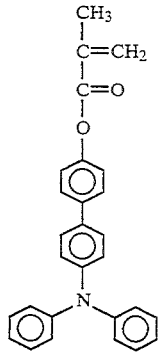
No. 2
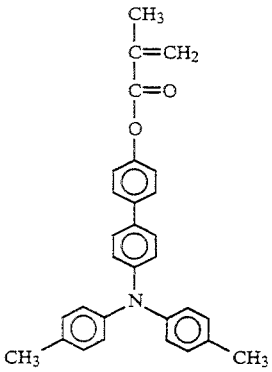
No. 3
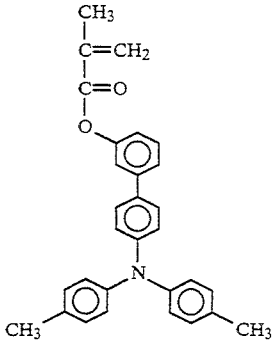
No. 4
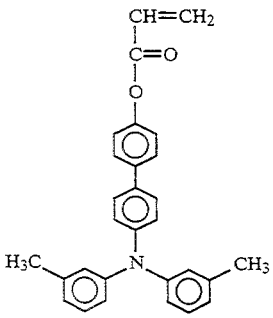
No. 5
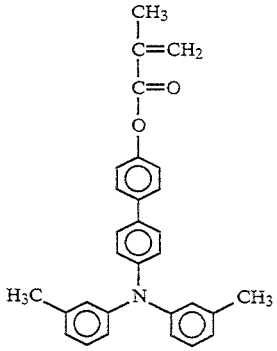
No. 6
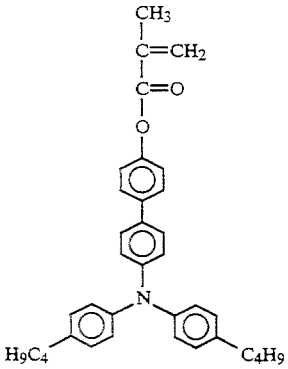
No. 7
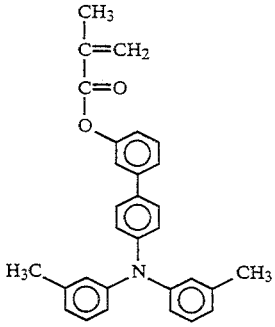
No. 8
-continued
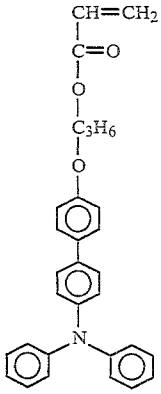
No. 9
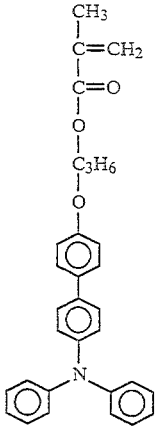
No. 10
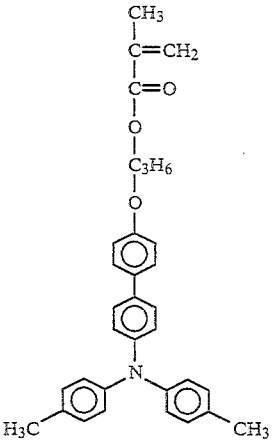
No. 11
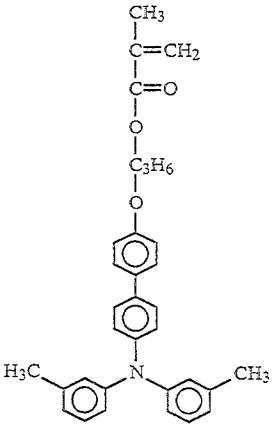
No. 12
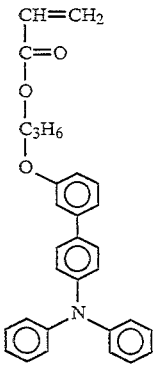
No. 13
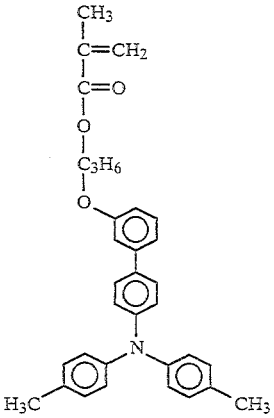
No. 14

-continued
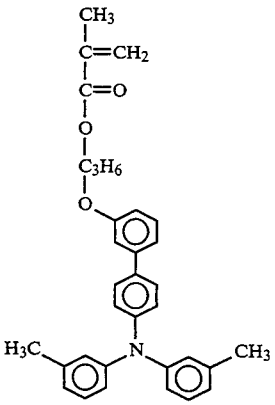
No. 15
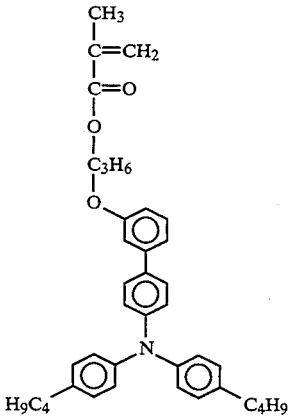
No. 16
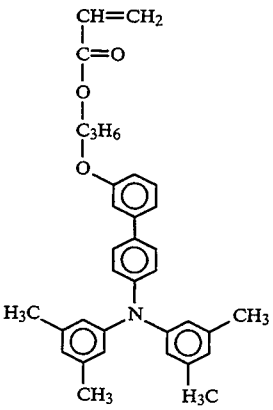
No. 17
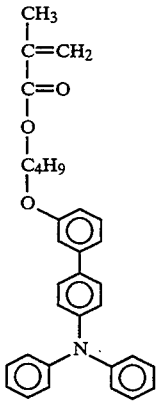
No. 18
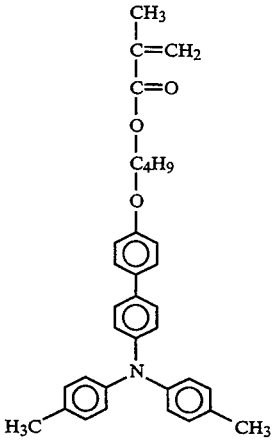
No. 19
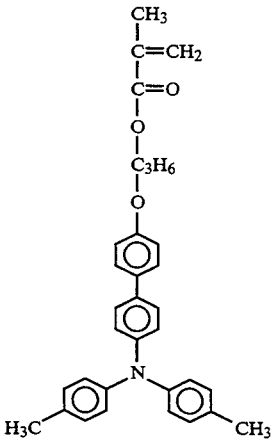
No. 20
-continued
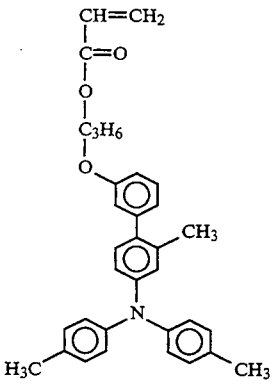
No. 21
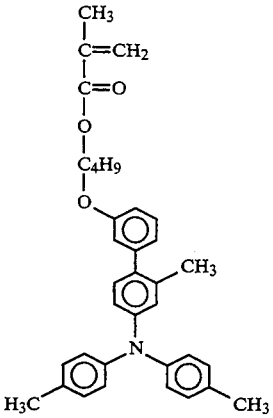
No. 22
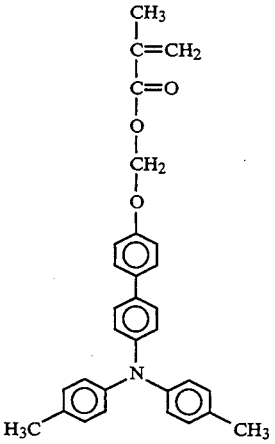
No. 23
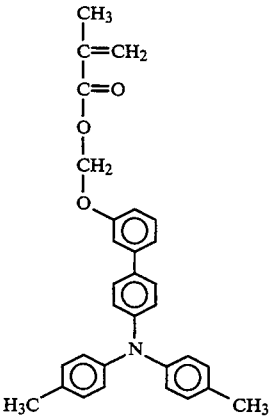
No. 24
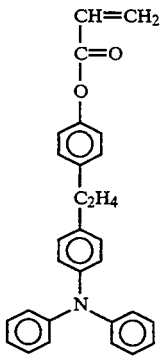
No. 25
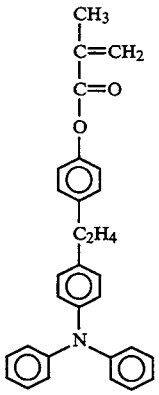
No. 26

-continued
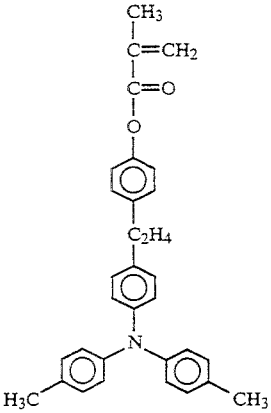
No. 27
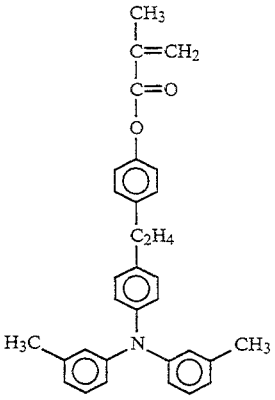
No. 28
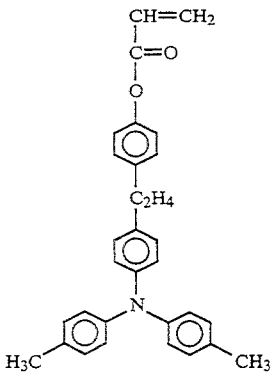
No. 29
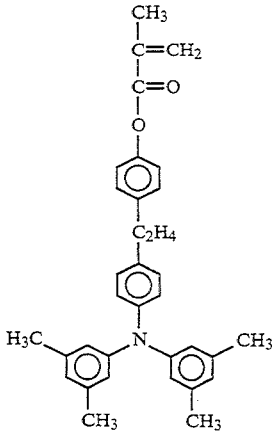
No. 30
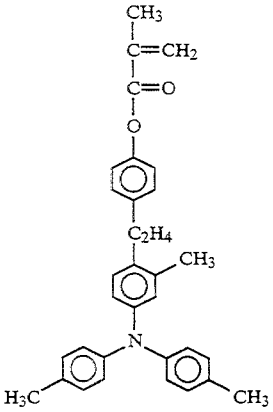
No. 31
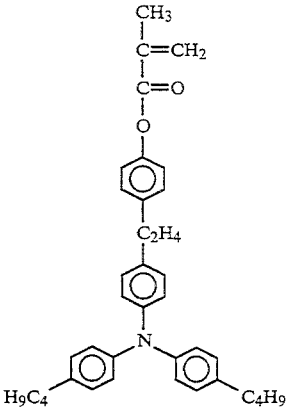
No. 32
-continued
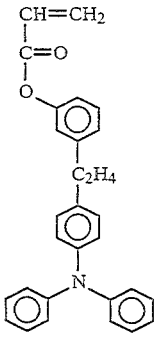
No. 33
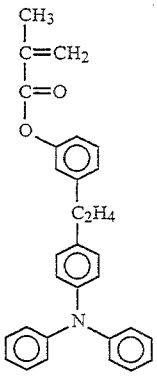
No. 34
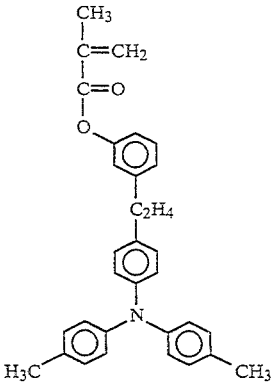
No. 35
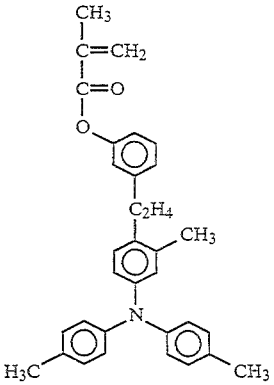
No. 36
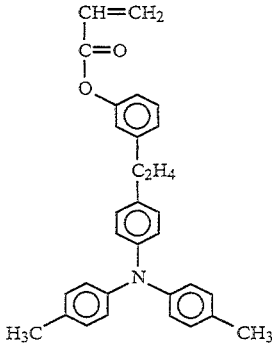
No. 37
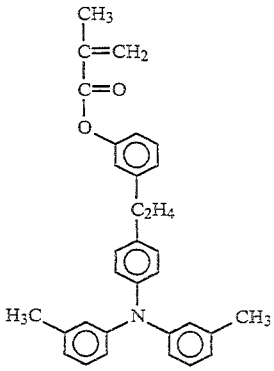
No. 38
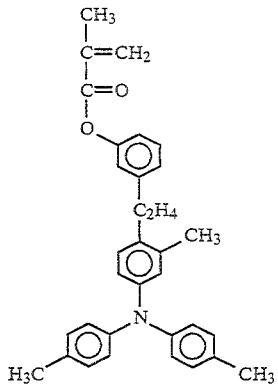
No. 39
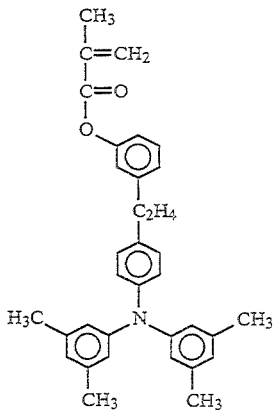
No. 40

-continued
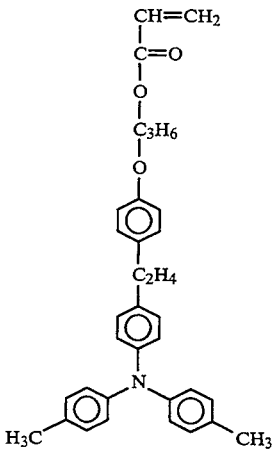
No. 41
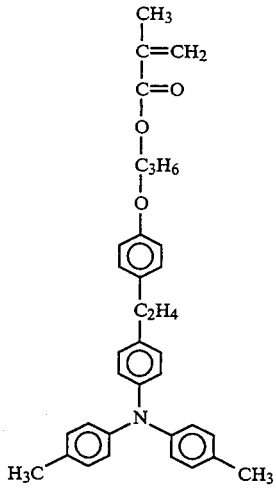
No. 42
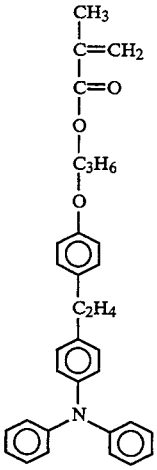
No. 43
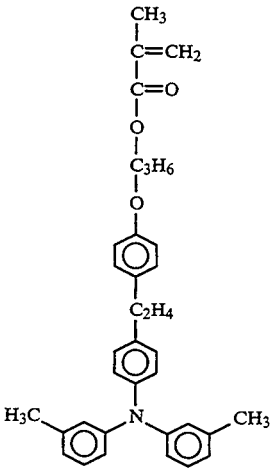
No. 44
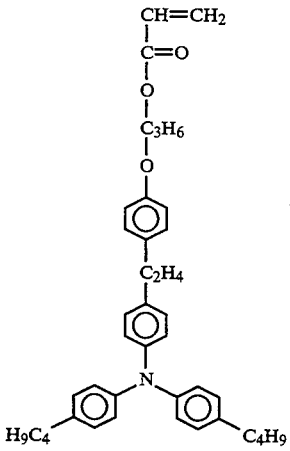
No. 45
-continued
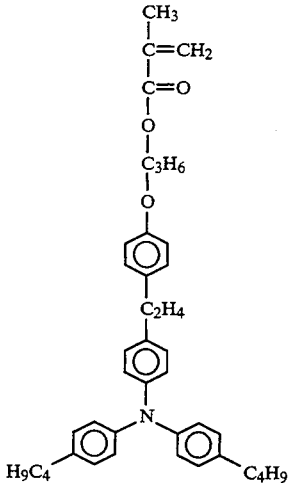
No. 46
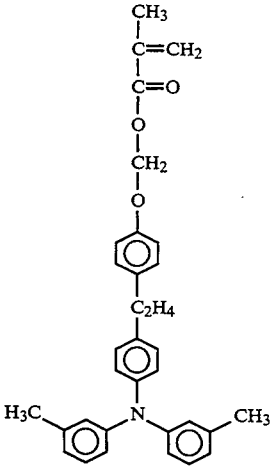
No. 47
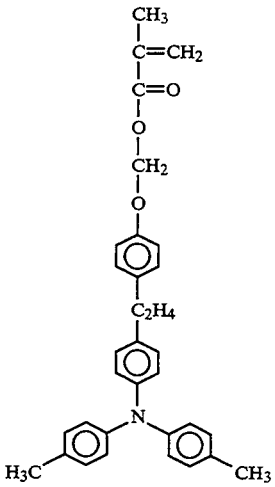
No. 48
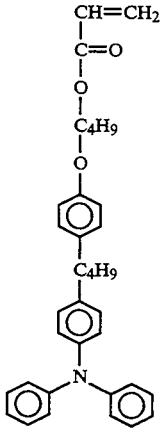
No. 49
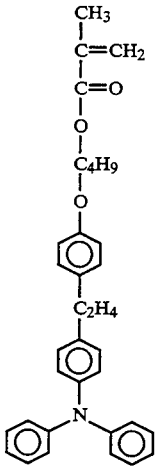
No. 50

-continued
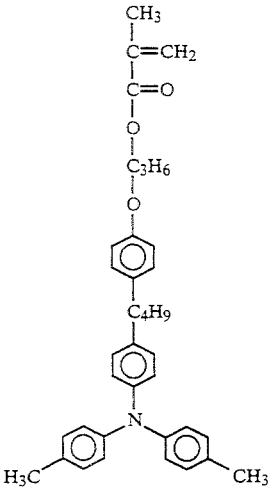
No. 51
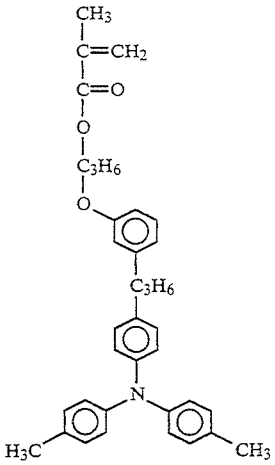
No. 52
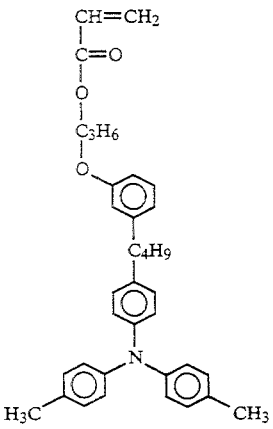
No. 53
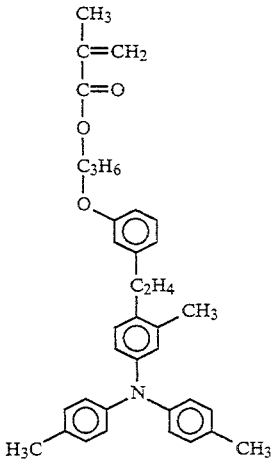
No. 54
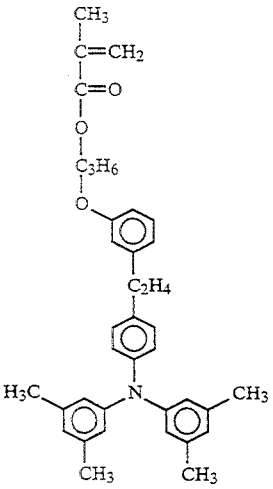
No. 55
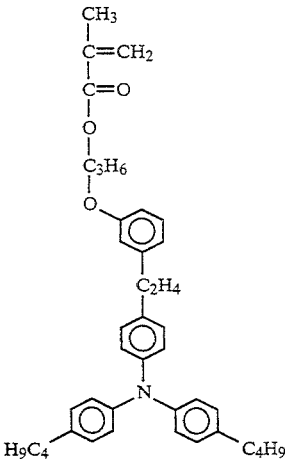
No. 56
-continued
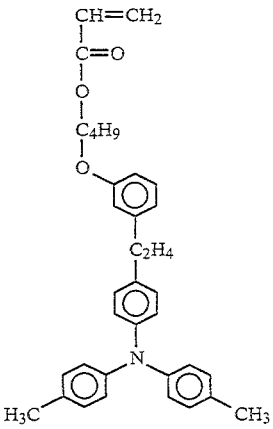
No. 57
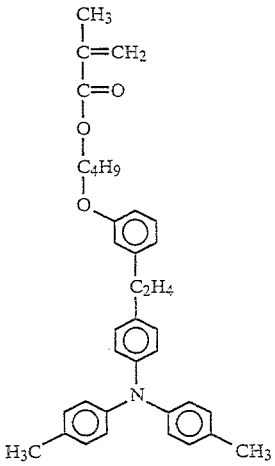
No. 58
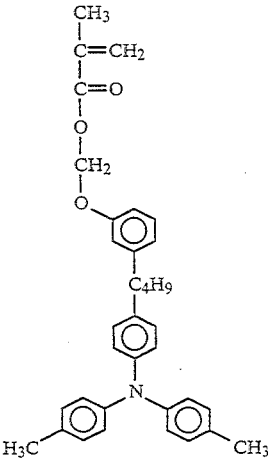
No. 59
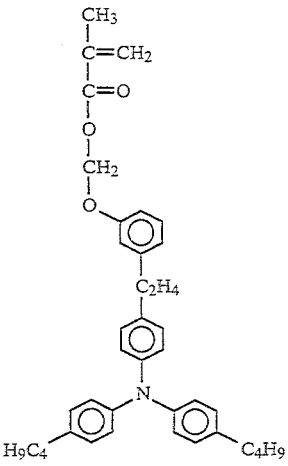
No. 60
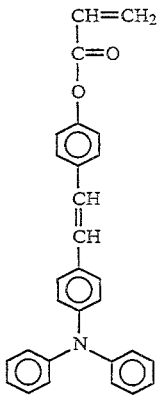
No. 61
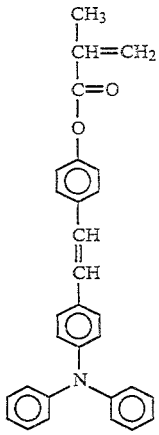
No. 62

-continued
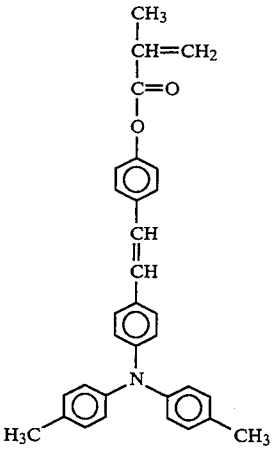
No. 63
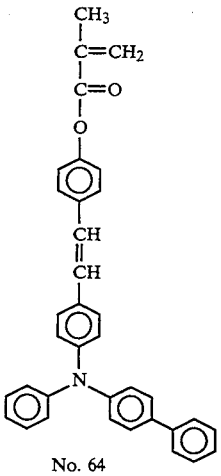
No. 64
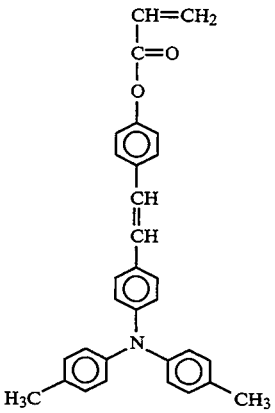
No. 65
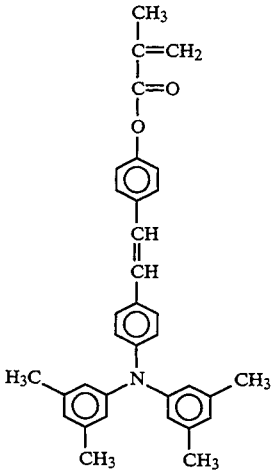
No. 66
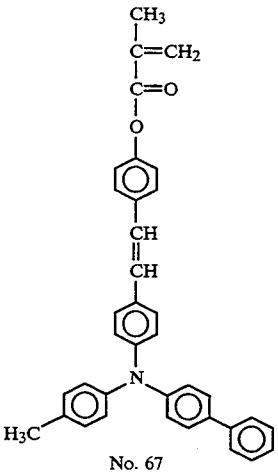
No. 67
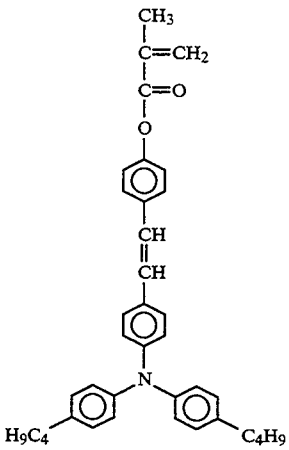
No. 68
-continued
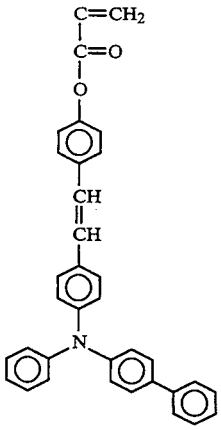
No. 69
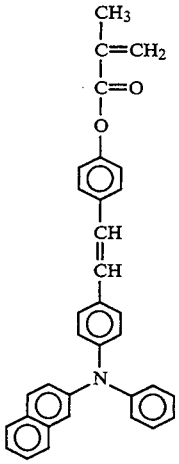
No. 70
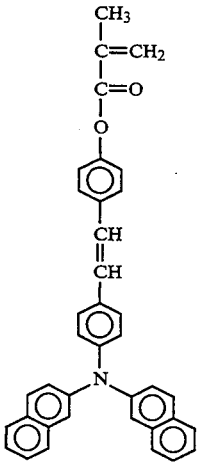
No. 71
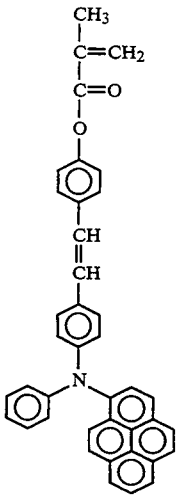
No. 72
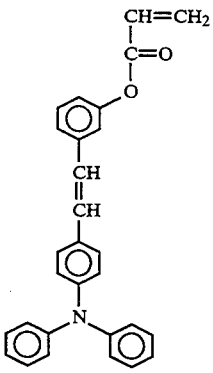
No. 73
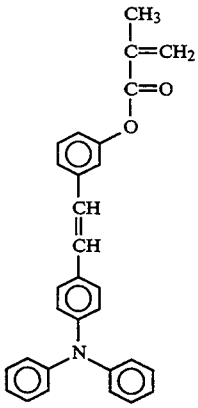
No. 74

-continued
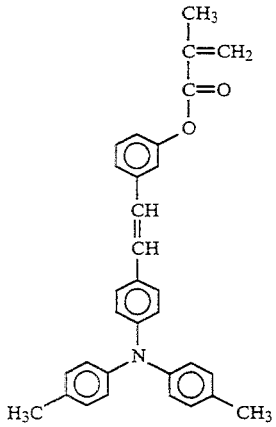
No. 75
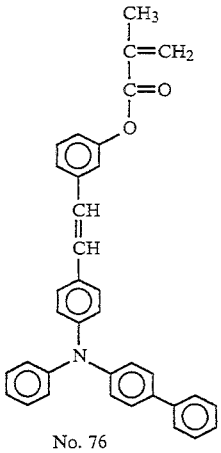
No. 76
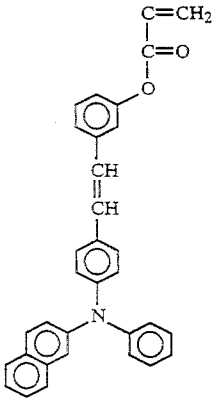
No. 77
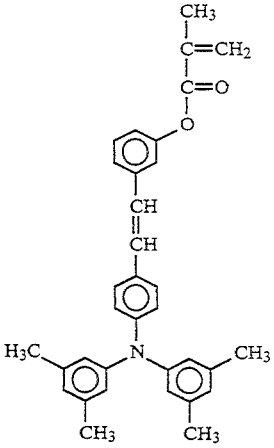
No. 78
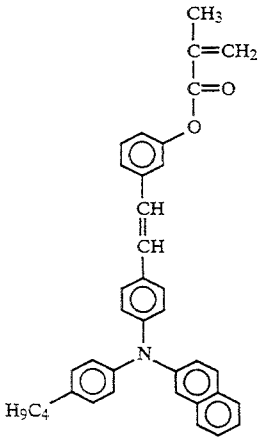
No. 79
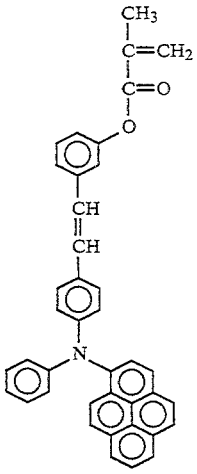
No. 80
-continued
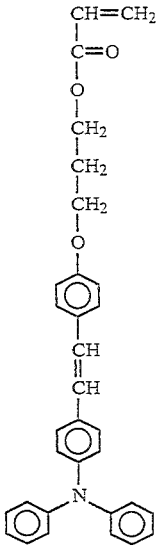
No. 81
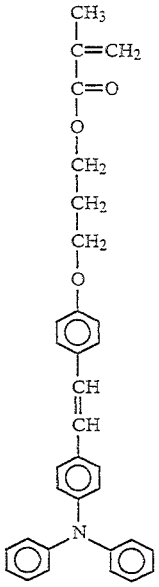
No. 82
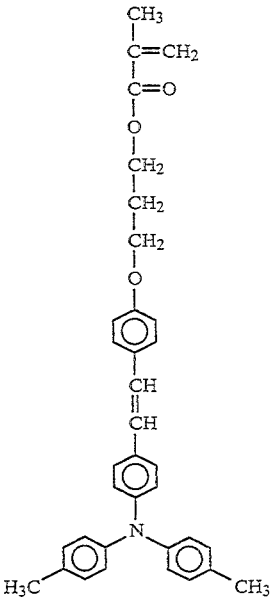
No. 83
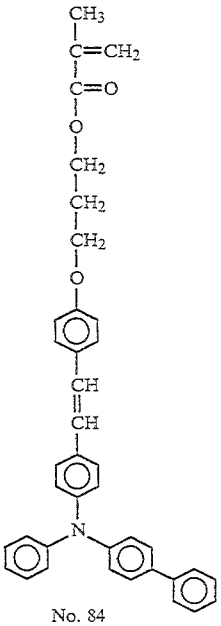
No. 84

-continued
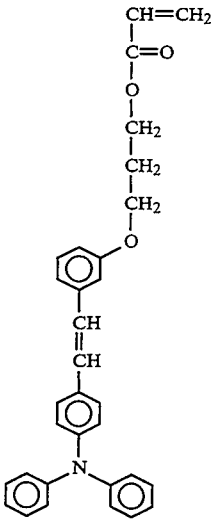
No. 85
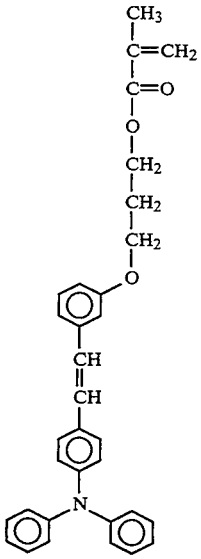
No. 86
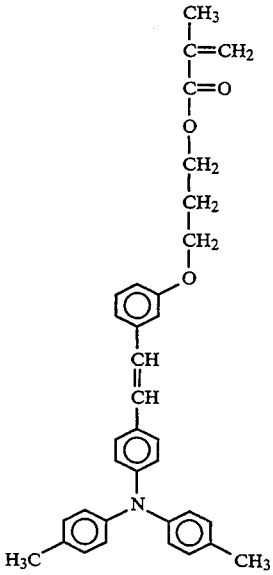
No. 87
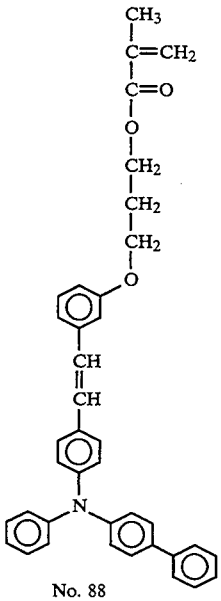
No. 88
(2) Carbon-carbon double-bond-containing monomers of formula (II):
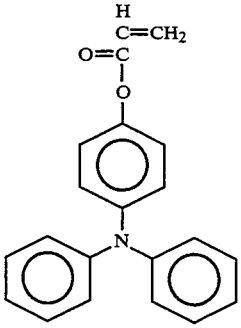
No. 89
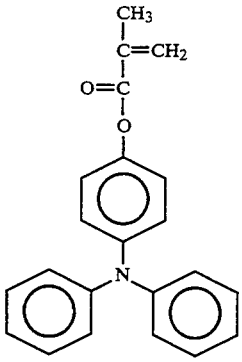
No. 90
-continued
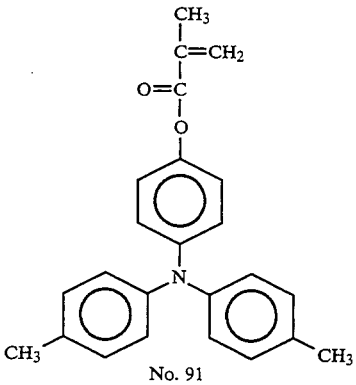
No. 91
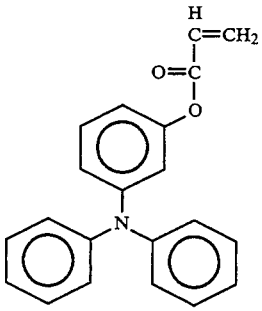
No. 92
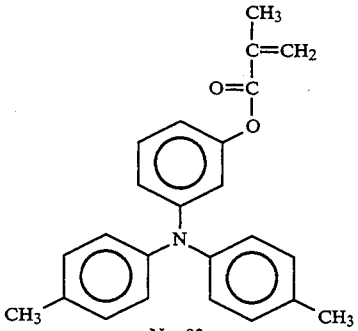
No. 93
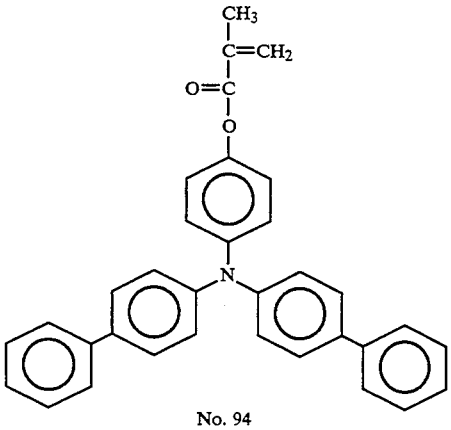
No. 94

-continued
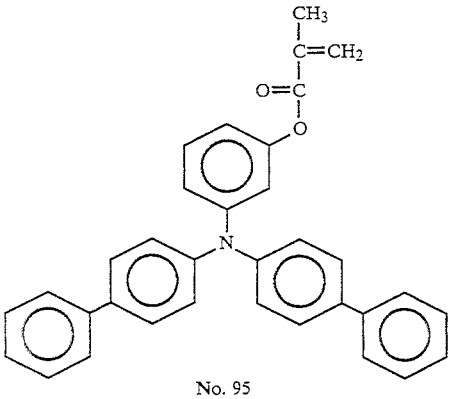
No. 95
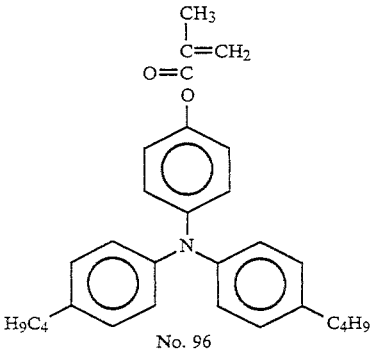
No. 96
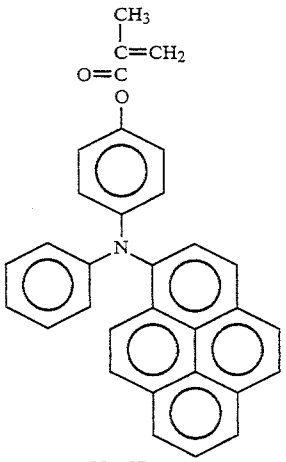
No. 97
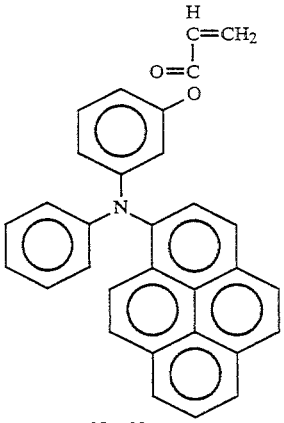
No. 98
-continued
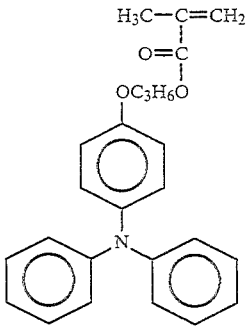
No. 99
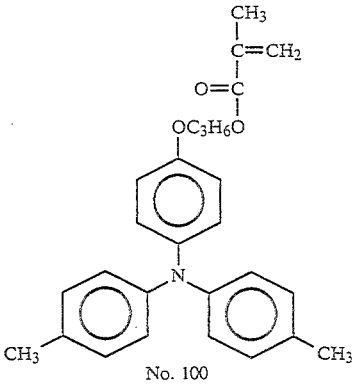
No. 100
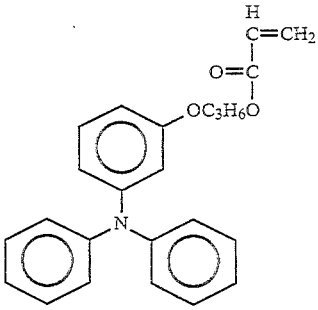
No. 101
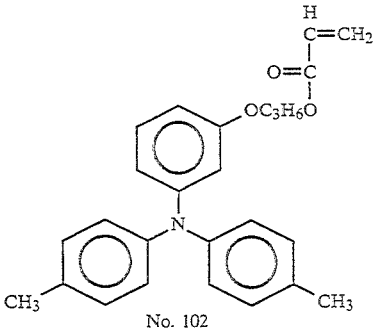
No. 102

-continued
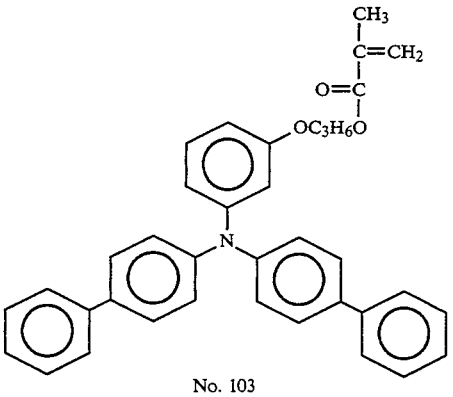
No. 103
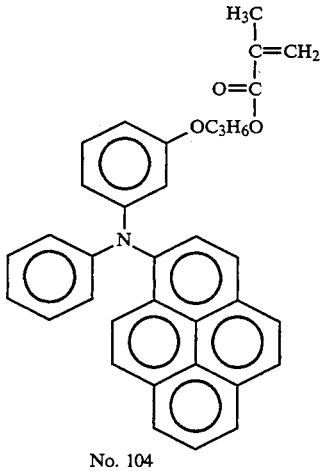
No. 104
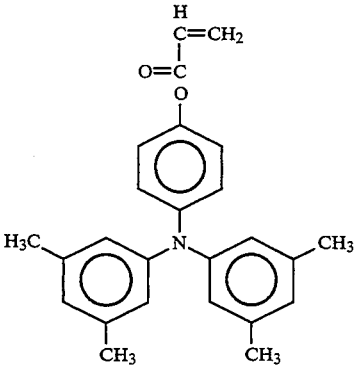
No. 105
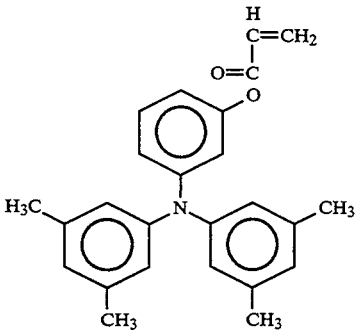
No. 106
-continued
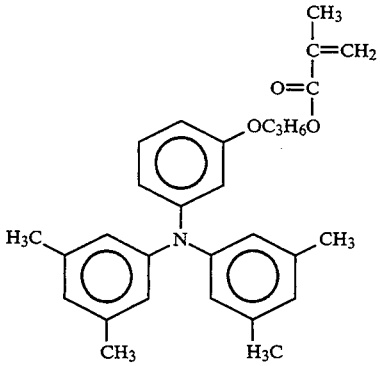
No. 107
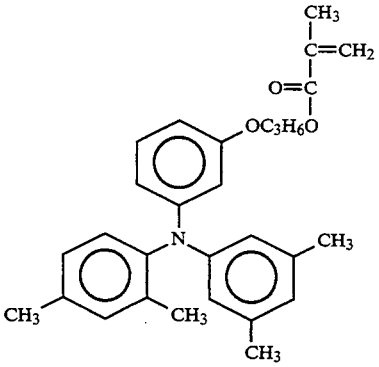
No. 108
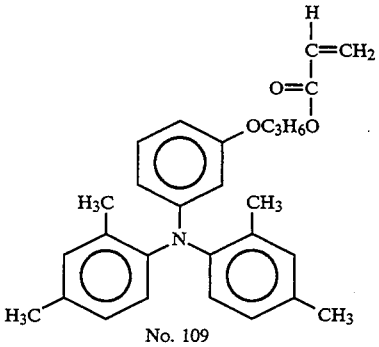
No. 109
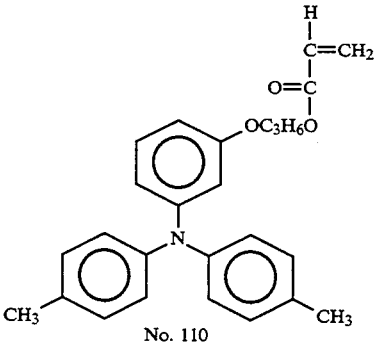
No. 110

-continued
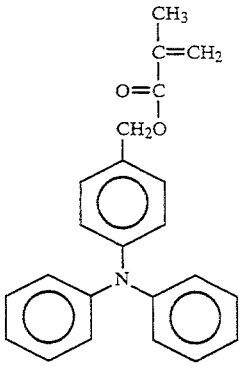
No. 111
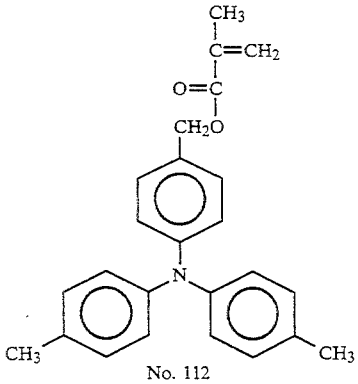
No. 112
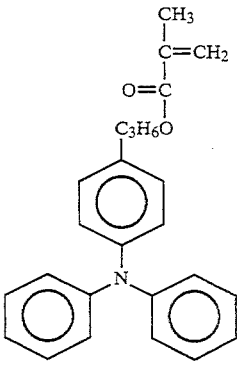
No. 113
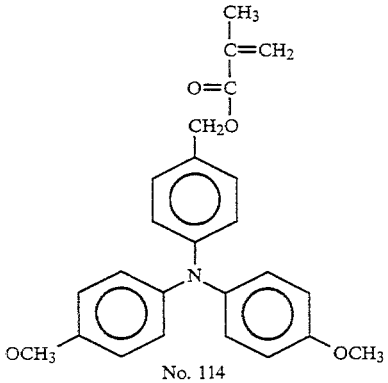
No. 114
-continued
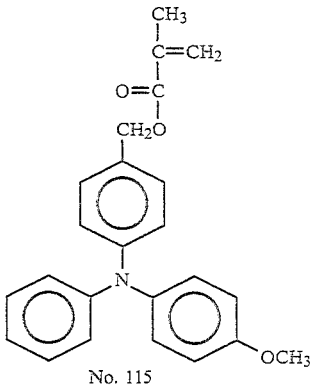
No. 115
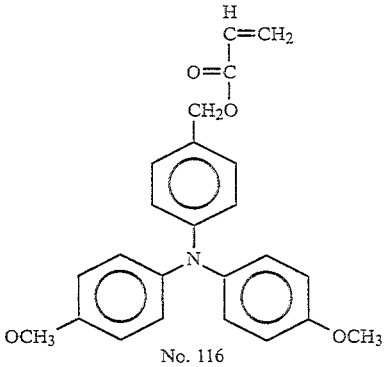
No. 116
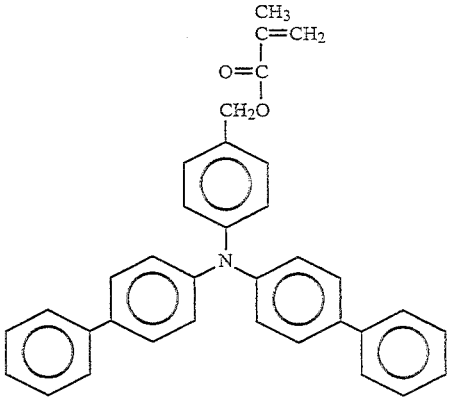
No. 117
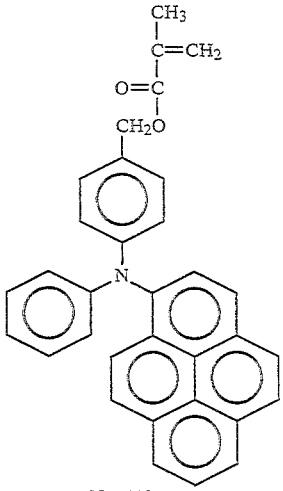
No. 118

-continued
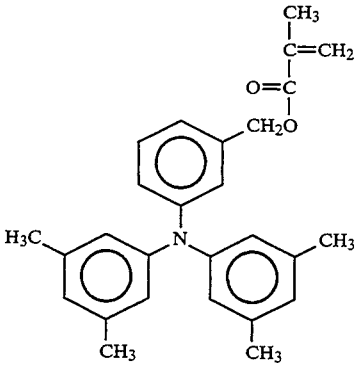
No. 119
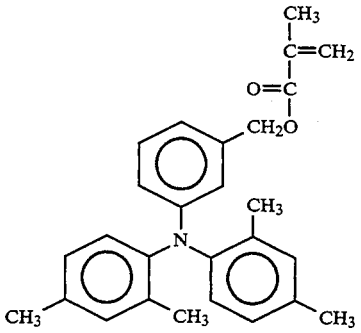
No. 120
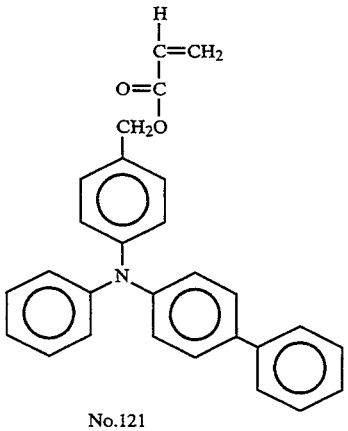
No.121
(3) Carbon-carbon double-bond-containing monomers of formula (III):
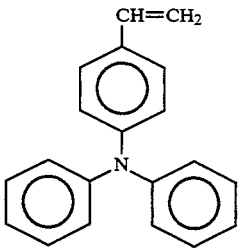
No. 122
-continued
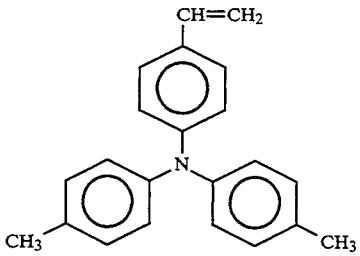
No. 123
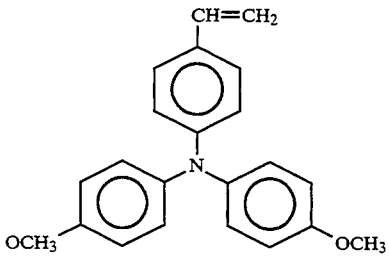
No. 124
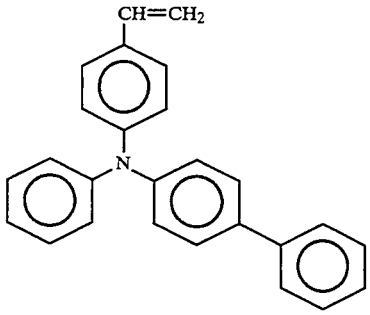
No. 125
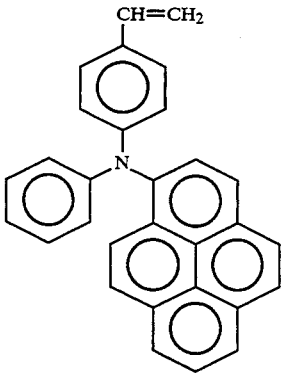
No. 126
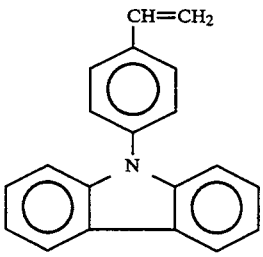
No. 127

-continued

No. 128

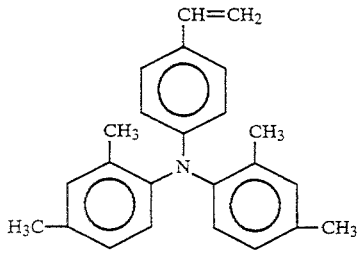

In the present invention, it is preferable from the viewpoint of mechanical strength of the obtained photoconductive layer that the binder resin for use in the interpenetrating polymer network for the photoconductive layer be a homopolymer or copolymer comprising a repeat unit represented by formula (IV):

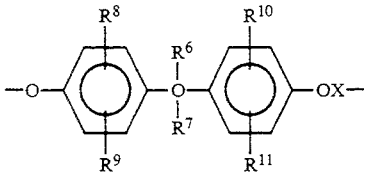

(IV)

wherein $R^6$ and $R^7$ each is hydrogen, an alkyl group having 1 to 10 carbon atoms, or an aryl group, and $R^6$ and R7 may form a cycloalkyl group in combination; $R^8$, $R^9$, $R^{10}$ and $R^{11}$ each is hydrogen, an alkyl group having 1 to 5 carbon atoms, an aryl group, a cycloalkyl group or a halogen; and X is

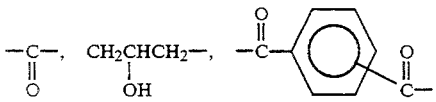

or

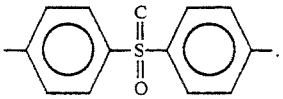

It is also preferable from the viewpoint of mechanical strength of the obtained photoconductive layer that the binder resin for use in the interpenetrating polymer network for the photoconductive layer be a vinyl homopolymer or a vinyl copolymer resin comprising a repeat unit represented by formula (V):

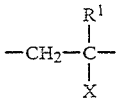

(V)

wherein $R^1$ is hydrogen or methyl group; and X is an aryl group or $COOR^2$, in which $R^2$ is an alkyl group having 1 to 3 carbon atoms or an aryl group.

One or more kinds of binder resins are employed to disperse the above-mentioned carbon-carbon double-bond-containing charge transporting monomer of formula (I), (II) or (III) therein. As previously mentioned, the binder resins comprising the repeat unit of formula (IV), for example, polycarbonate resin, phenoxy resin, polyester resin and polysulfone resin are preferable because such binder resins are polymers in the state of ductile glass. Therefore, these binder resins are provided with toughness and high-impact properties and the resistance to scratches.

It is preferable that the viscosity-average molecular weight of the above-mentioned binder resin comprising the repeat unit of formula (IV) be in the range from 10,000 to 100,000, more preferably in the range from 20,000 to 60,000. It is preferable that the polymerization degree obtained from the number-average molecular weight of the resin with the repeat unit of formula (IV) in terms of polystyrene molecular weight by gas permeation chromatography (GPC) be in the range from 50 to 400, more preferably in the range from 80 to 300. Another advantage of the binder resin comprising the repeat unit of formula (IV) is that the compatibility with the charge transporting monomer of formula (I), (II) or (III) is excellent, so that the obtained photoconductive layer is a clear transparent film, and accordingly, electrophotographic characteristics are improved.

Specific examples of the binder resin which is a homopolymer comprising the repeat unit of formula (IV) are shown in Table 1.

TABLE 1

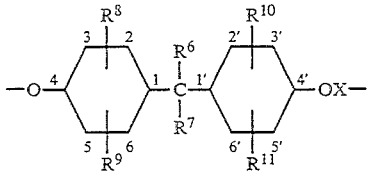

| No. | $R^6$ | $R^7$ | $R^8$ | $R^9$ | $R^{10}$ | $R^{11}$ | X |
|---|---|---|---|---|---|---|---|
| 1 | $-CH_3$ | $-CH_3$ | H | H | H | H | $-\overset{O}{\overset{\|\|}{C}}-$ |
| 2 | $-CH_3$ | $-CH_3$ | 3-$CH_3$ | H | 3'-$CH_3$ | H | $-\overset{O}{\overset{\|\|}{C}}-$ |
| 3 | $-CH_3$ | $-CH_3$ | 3-$CH_3$ | 5-$CH_3$ | 3'-$CH_3$ | 5'-$CH_3$ | $-\overset{O}{\overset{\|\|}{C}}-$ |
| 4 | $-CH_3$ | $-CH_3$ | 3-Br | 5-Br | 3'-Br | 5'-Br | $-\overset{O}{\overset{\|\|}{C}}-$ |

TABLE 1-continued

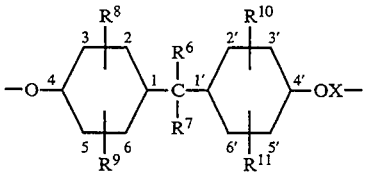

| No. | $R^6$ | $R^7$ | $R^8$ | $R^9$ | $R^{10}$ | $R^{11}$ | X |
|---|---|---|---|---|---|---|---|
| 5 | H | $-CH_3$ | H | H | H | H | $-\overset{O}{\overset{\|\|}{C}}-$ |
| 6 | $-CH_3$ | $-C_4H_9$ | H | H | H | H | $-\overset{O}{\overset{\|\|}{C}}-$ |
| 7 | $-CH_3$ | $-CH_3$ | 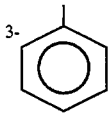 | H | 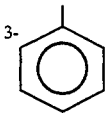 | H | $-\overset{O}{\overset{\|\|}{C}}-$ |
| 8 | $-CH_3$ | 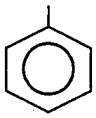 | H | H | H | H | $-\overset{O}{\overset{\|\|}{C}}-$ |
| 9 | $-CH_3$ | 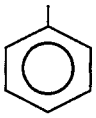 | 3-$CH_3$ | H | 3'-$CH_3$ | H | $-\overset{O}{\overset{\|\|}{C}}-$ |
| 10 | H | H | H | H | H | H | $-\overset{O}{\overset{\|\|}{C}}-$ |
| 11 | 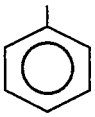 | 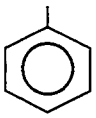 | H | H | H | H | $-\overset{O}{\overset{\|\|}{C}}-$ |
| 12 | $-CF_3$ | $-CF_3$ | H | H | H | H | $-\overset{O}{\overset{\|\|}{C}}-$ |
| 13 | 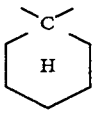 | | H | H | H | H | $-\overset{O}{\overset{\|\|}{C}}-$ |
| 14 | 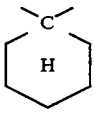 | | 3-$CH_3$ | H | 3'-$CH_3$ | H | $-\overset{O}{\overset{\|\|}{C}}-$ |
| 15 | 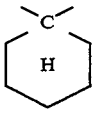 | | 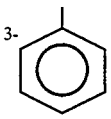 | H | 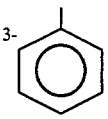 | H | $-\overset{O}{\overset{\|\|}{C}}-$ |
| 16 | 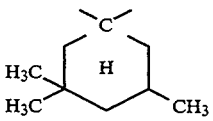 | | H | H | H | H | $-\overset{O}{\overset{\|\|}{C}}-$ |

TABLE 1-continued
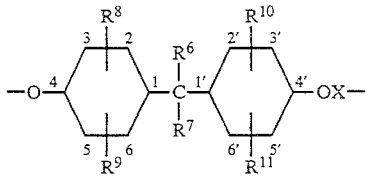
| No. | $R^6$ | $R^7$ | $R^8$ | $R^9$ | $R^{10}$ | $R^{11}$ | X |
|---|---|---|---|---|---|---|---|
| 17 | 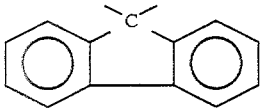 | | H | H | H | H | 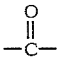 |
| 18 | 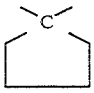 | | H | H | H | H | 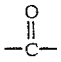 |
| 19 | 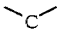 | $(CH_2)_6$ | H | H | H | H | 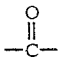 |
| 20 | $-CH_3$ | $-CH_3$ | H | H | H | H | 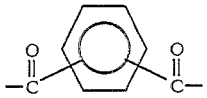 |
| 21 | $-CH_3$ | $-CH_3$ | 3-$CH_3$ | H | 3'-$CH_3$ | H | 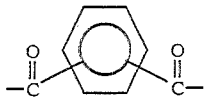 |
| 22 | $-CH_3$ | $-CH_2$ 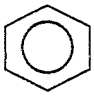 | H | H | H | H | 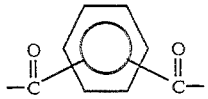 |
| 23 | $-CH_3$ | 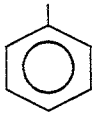 | H | H | H | H | 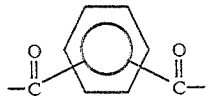 |
| 24 | $-CH_3$ | $-CH_3$ | 3-$C_3H_7$ | H | 3'-$C_3H_7$ | H | 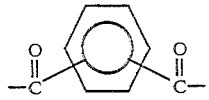 |
| 25 | $-CH_3$ | $-CH_3$ | 3- 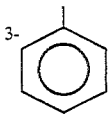 | H | 3'- 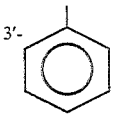 | H | 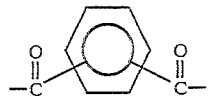 |
| 26 | 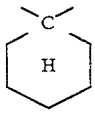 | | H | H | H | H | 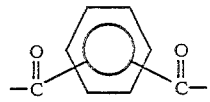 |
| 27 | 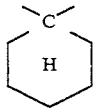 | | 3-$CH_3$ | H | 3'-$CH_3$ | H | 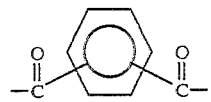 |

TABLE 1-continued

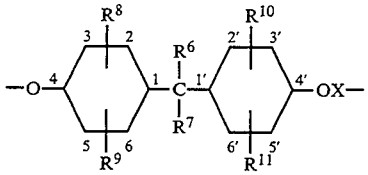

| No. | $R^6$ | $R^7$ | $R^8$ | $R^9$ | $R^{10}$ | $R^{11}$ | X |
|---|---|---|---|---|---|---|---|
| 28 | $-CH_3$ | $-CH_3$ | H | H | H | H | $-CH_2CH(OH)CH_2-$ |
| 29 | 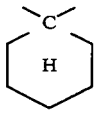 | | H | H | H | H | $-CH_2CH(OH)CH_2-$ |
| 30 | $-CH_3$ | $-CH_3$ | H | H | H | H | 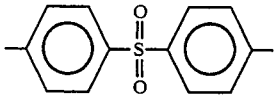 |
| 31 | $-CH_3$ | $-CH_3$ | 3-Cl | H | 3'-Cl | H | 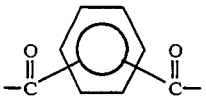 |

The binder resin may be a copolymer comprising the repeat unit of formula (IV). Specific examples of the binder resin which is a copolymer comprising the repeat unit of formula (IV) are shown in Table 2.

TABLE 2

Copolymer of: 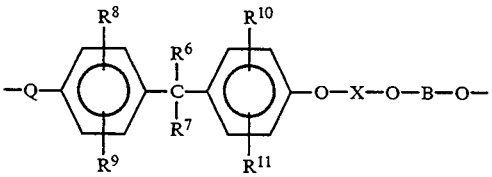

| No. | Bisphenol Compound | X | B |
|---|---|---|---|
| 32 | 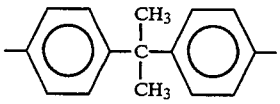 | $-\overset{O}{\overset{\|\|}{C}}-$ | 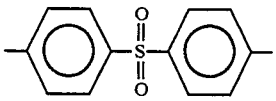 |
| 33 | 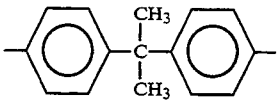 | $-\overset{O}{\overset{\|\|}{C}}-$ | 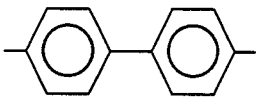 |
| 34 | 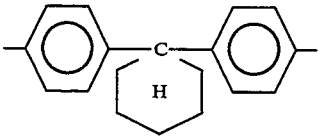 | $-\overset{O}{\overset{\|\|}{C}}-$ | 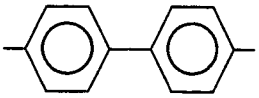 |
| 35 | 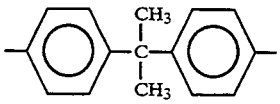 | $-\overset{O}{\overset{\|\|}{C}}-$ | 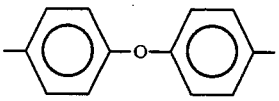 |

TABLE 2-continued

Copolymer of: 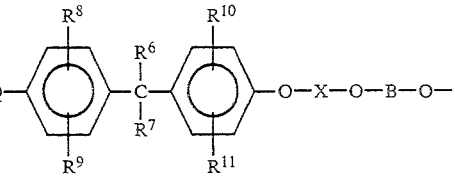

| No. | Bisphenol Compound | X | B |
|---|---|---|---|
| 36 | 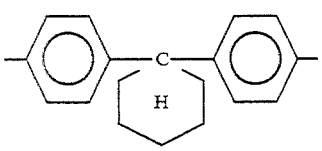 | 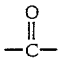 | 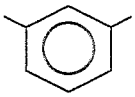 |
| 37 | 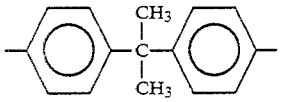 | 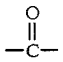 | 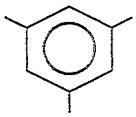 |
| 38 | 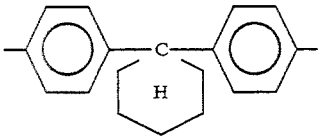 | 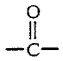 | $\leftarrow OCH_3CH_2 \rightarrow_6$ |
| 39 | 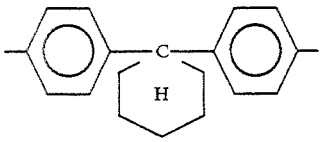 | 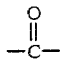 | 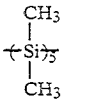 |
| 40 | 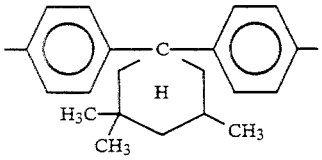 | 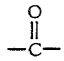 | 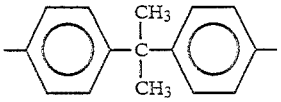 |
| 41 | 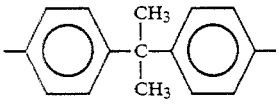 | 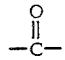 | 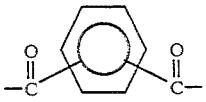 |
| 42 | 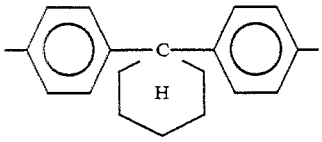 | 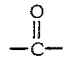 | 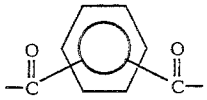 |
| 43 | 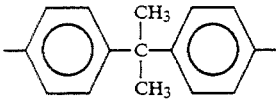 | 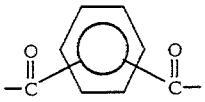 | $-CC_4H_8C-$ |

The binder resins comprising the repeat unit of formula (V) are also preferably employed together with the charge transporting monomers of formula (I), (II), and (III). Such binder resins, which are available in the form of a vinyl homopolymer of the repeat unit of formula (V) or a vinyl copolymer resin comprising the repeat unit of formula (V), have good film-forming properties and good compatibility with the charge transporting monomers of formula (I), (II) and (III), so that the obtained photoconductive layer is a clear transparent film, and accordingly, the electrophotographic characteristics are improved.

Specific examples of the obtained vinyl resins comprising the repeat unit of formula (V) include polystyrene, polymethyl methacrylate, styrene—methyl methacrylate copolymer, styrene—methyl methacrylate—butyl methacrylate copolymer, and styrene—butadiene copolymer.

It is preferable that the molecular weight of the obtained vinyl resin comprising the repeat unit of formula (V) be 10,000 or more, and more preferably 100,000 or more.

In the present invention, a coating liquid for the photoconductive layer comprises the previously mentioned charge transporting monomer of formula (I), (II) or (III) and the binder resin such as a resin comprising the repeat unit of formula (IV) or (V). In this case, it is preferable that the amount ratio by weight of the charge transporting monomer to the binder resin be in the range from 10:(5 to 50), and more preferably 10:(7 to 30). When the mixing ratio is within the above range, the fragility of the obtained photoconductive layer can be improved and the adhesion of the photoconductive layer to the layer provided thereunder is good, so that the peeling of the photoconductive layer can be prevented even when some impact is applied to the photoconductor. At the same time, the photosensitivity of the obtained photoconductor does not decrease and the residual potential does not increase.

A reaction initiator may be employed or not in the polymerization of the charge transporting monomer in the present invention. When the photoconductive layer is obtained by curing under the application of heat, a peroxide such as 2,5-dimethylhexane, 2,5-dihydroperoxide, dicumyl peroxide, benzoyl peroxide, t-butylcumyl peroxide, and 2,5-dimethyl-2,5-di(peroxybenzoyl)hexyne-3; and an azo compound such as azobisisobutyronitrile are employed as the reaction initiators. As photo-setting initiators, ketone compounds such as Michler's ketone, benzoin isopropyl ether, and 1-hydroxycyclohexylphenylketone can be used.

To prepare a coating liquid for the photoconductive layer, a composition of the previously mentioned charge transporting monomer of formula (I), (II) or (III) and the binder resin is dissolved in an appropriate solvent.

Examples of the above-mentioned solvent are ketones such as methyl ethyl ketone and cyclohexanone; esters such as ethyl acetate and butyl acetate; ethers such as tetrahydrofuran and dioxane; halogen-containing solvents such as dichloroethane and chlorobenzene; and aromatic solvents such as toluene and xylene.

In the case of the heat polymerization, the polymerization of the charge transporting monomer is carried out at 80° to 170° C. for 20 to 60 minutes. When the reaction initiator is added to the composition comprising the charge transporting monomer, it is desirable to begin the coating operation as soon as possible and carry out the heat polymerization in a stream of nitrogen. It is preferable that the molar ratio of the reaction initiator to the charge transporting monomer be in the range from 0.001 to 0.1. When the amount of the reaction initiator is within the above-mentioned range, it is possible to prevent the deterioration of the electrical characteristics of the photoconductor which is caused by the residual decomposition product of the reaction initiator.

The polymerization reaction of an acryl-based charge transporting monomer can be initiated by exposing it to the ultraviolet light without any catalyst. For instance, using a mercury vapor lamp as a light source, the ultraviolet light with a light volume of 40 to 120 W/cm is applied to the charge transporting monomer for 1 to 2 minutes. The addition of a catalyst accelerate the polymerization rate, so that the time required to apply the ultraviolet light to the charge transporting monomer can be curtailed. The charge transporting monomer of formula (I), (II) or (III) for use in the present invention becomes active to the ultraviolet light and can initiate the polymerization without any catalyst.

In the present invention, a low-molecular weight charge transporting material conventionally used as the CTM may be used in combination with the previously mentioned carbon-carbon double-bond-containing charge transporting monomer.

Examples of the conventional low-molecular weight charge transporting material are as follows: oxazole derivatives and oxadiazole derivatives (Japanese Laid-Open Patent Applications 52-139065 and 52-139066); benzidine derivatives (Japanese Patent Publication 58-32372); imidazole derivatives and triphenylamine derivatives (Japanese Patent Application 1-77839); α-phenylstilbene derivatives (Japanese Laid-Open Patent Application 57-73075); hydrazone derivatives (Japanese Laid-Open Patent Applications 55-154955, 55-156954, 55-52063, and 56-81850); triphenylmethane derivatives (Japanese Patent Publication 51-10983); anthracene derivatives (Japanese Laid-Open Patent Application 51-94829); styryl derivatives (Japanese Laid-Open Patent Applications 56-29245 and 58-198043); carbazole derivatives (Japanese Laid-Open Patent Application 58-58552); and pyrene derivatives (Japanese Laid-Open Patent Application 2-94812). It is preferable that the amount ratio by weight of such a conventional low-molecular weight charge transporting material to the charge transporting monomer of formula (I), (II) or (III) be in the range from (0.1:10) to (10:10).

The photoconductive layer of the photoconductor according to the present invention may comprise a charge generation layer (CGL) and a charge transport layer (CTL).

The charge generation layer (CGL) comprises a charge generating material (CGM) and a binder resin when necessary.

As the charge generating material for use in the present invention, a condensed polycyclic quinone compound such as Vat Orange 3 (C.I. No. 59300); a perylene compound (C.I. No. 38001); an azo pigment having a carbazole skeleton (Japanese Laid-Open Patent Application 53-95033), an azo pigment having a stilbene skeleton (Japanese Laid-Open Patent Application 53-138229), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-17734), a trisazo pigment having a carbazole skeleton (Japanese Laid-open Patent Applications 57-195767 and 57-195768), and an azo pigment having an anthraquinone skeleton (Japanese Laid-Open Patent Application 57-202545); a squaric salt pigment; a metal-containing or metal-free phthalocyanine pigment; selenium and alloys thereof; and s-silicon (amorphous silicon) can be employed.

As the electroconductive substrate of the electrophotographic photoconductor according to the present invention, an electroconductive metal or alloy such as aluminum, copper, nickel or stainless steel can be employed. Alternatively, an inorganic electrically-insulating material such as a ceramic material; and an organic electrically-insulating material such as polyester, polyimide, phenolic resin, nylon resin or paper, which may be in the form of a drum, sheet, or plate, may be coated with an electroconductive material such as aluminum, copper, nickel, stainless steel, carbon black, tin oxide, indium oxide, antimony oxide or an electroconductive titanium oxide by vacuum deposition, sputtering or spray coating. On the electroconductive substrate thus obtained, the coating liquid for the photoconductive layer comprising the charge transporting monomer, the binder resin and the charge generating material is coated to form a photoconductive layer.

When the electrophotographic photoconductor according to the present invention is a negatively-chargeable photoconductor comprising an electroconductive substrate, and a charge generation layer and a charge transport layer which are successively provided on the substrate in this order, the photoconductor is fabricated by the following method. The previously mentioned charge generating material is pulverized and dispersed in an appropriate solvent in a ball mill, a beads mill, or an oscillating mill until the average particle diameter of the charge generating material reaches 0.3 μm or less to prepare a coating liquid for the charge generation layer. Examples of the solvent are ketones such as methyl ethyl ketone and cyclohexanone; ethers such as tetrahydrofuran and dioxane; esters such as ethyl acetate; halogen-containing solvents such as dichloroethane and chlorobenzene; and aromatic solvents such as toluene and xylene.

When the charge generating material is dispersed and pulverized in the solvent, a binder resin such as polyvinyl butyral, polyvinyl acetal, cellulose derivatives, phenolic resin, epoxy resin, or acryl polyol may be added to the charge generating material.

When the coating liquid for the charge generation layer does not comprise the above-mentioned binder resin, an intermediate layer may be provided between the electroconductive substrate and the charge generation layer for preventing the injection of electric charge into the charge generation layer from the electroconductive substrate. The intermediate layer for use in the present invention comprises a binder resin such as polyamide, polyacrylanilide, casein, vinyl chloride—vinyl acetate—maleic acid copolymer or phenolic resin.

The charge generation layer coating liquid is coated on the electroconductive substrate by a conventional method such as dip coating, spray coating or roll coating. It is preferable that the thickness of the charge generation layer be in the range from 0.05 to 5 μm, and more preferably in the range from 0.05 to 1 μm.

After the formation of the charge generation layer, a coating liquid for the charge transport layer is coated on the charge generation layer, and the polymerization reaction of the charge transporting monomer is carried out by heating to 60° to 200° C. or exposing to the light. It is preferable that the thickness of the charge transport layer be in the range from 15 to 50 μm. In addition, it is desirable from the viewpoint of the improvement of photosensitivity that the previously mentioned low-molecular weight charge transporting material be used in combination with the charge transporting monomer of formula (I), (II), or (III) at the ratio by weight of (0.01 to 1):10.

When a positively-chargeable electrophotographic photoconductor is prepared by successively providing a charge transport layer and a charge generation layer in this order on an electroconductive substrate, the photoconductor is fabricated by the following method. The charge transport layer with a thickness of 15 to 50 μm is provided on the substrate by the conventional method. Then, the previously mentioned charge generating material is pulverized and dispersed together with the binder resin when necessary. After that, the binder resin such as a resin comprising the repeat unit of formula (IV) or (V) and the charge transporting monomer of formula (I), (II) or (III) are added to a dispersion of the charge generating material, so that a coating liquid for the charge generation layer is prepared. The charge generation layer coating liquid is coated on the charge transport layer by the previously mentioned coating method. The proper thickness of the charge generation layer is in the range from 0.5 to 10 μm.

In this case, it is preferable that the amount ratio by weight of the charge transporting monomer of formula (I), (II), or (III) to the binder resin such as a resin with a repeat unit of formula (IV) or (V) to the charge generating material in the charge generation layer coating liquid be 10:(7 to 30):(2 to 10).

In the charge generation layer, a polyether compound such as polyethylene glycol, a cyclic ether compound such as crown ether, and a phosphite compound such as tridecyl phosphite may be contained as additive components to prevent the deterioration of charging characteristics of the photoconductor in the repeated copying operation. In this case, it is preferable that the amount ratio by weight of the charge generating material to the additive components be 10:(0.1 to 5).

When a single-layered photoconductive layer is provided on an electroconductive substrate, the photoconductive layer is prepared by polymerizing a composition comprising the charge generating material, the charge transporting monomer of formula (I), (II) or (III), and the binder resin such as a resin with the repeat unit of formula (IV) or (V). In this case, it is preferable that the amount ratio by weight of the charge transporting monomer to the binder resin to the charge generating material in the photoconductive layer coating liquid be 10:(7 to 30):(2 to 10). The previously mentioned additive components serving to prevent the deterioration of the charging characteristics may be contained in the single-layered photoconductive layer.

Furthermore, a plurality of charge transport layers may be provided on the charge generation layer in the preparation of the negatively-chargeable electrophotographic photoconductor. In such a case, a charge generation layer and a charge transport layer comprising the binder resin and the conventional low-molecular weight charge transporting material are successively overlaid on an electroconductive substrate in this order, and a charge transport layer prepared by polymerizing the composition comprising the charge transporting monomer of formula (I), (II), or (III) and the binder resin such as a resin with the repeat unit of formula (IV) or (V) may be provided at the top position of the photoconductor. In this case, the proper thickness of the top charge transport layer, serving as a protective layer, is in the range from 0.5 to 2 μm.

Other features of this invention will become apparent in the course of the following description of exemplary embodiments, which are given for illustration of the invention and are not intended to be limiting thereof.

EXAMPLE 1

Formation of Intermediate Layer

A polyamide resin (Trademark "CM-8000", made by Toray Industries, Inc.) was coated on an aluminum cylinder with a diameter of 80 mm and a length of 340 μm serving as an electroconductive substrate by spray coating, and dried, so that an intermediate layer with a thickness of 0.3 μm was formed on the electroconductive substrate.

Formation of Charge Generation Layer

An azo pigment of the following formula was pulverized and dispersed in cyclohexanone.

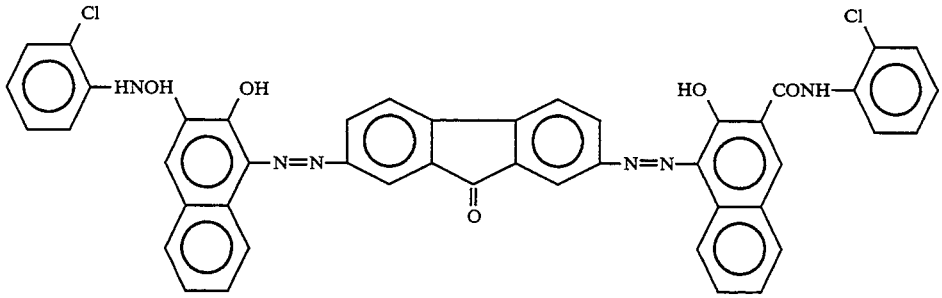

The thus obtained dispersion was coated on the above prepared intermediate layer by spray coating, and dried, so that a charge generation layer with a thickness of 0.2 μm was formed on the intermediate layer.

Formation of Charge Transport Layer

The following components were mixed to prepare a coating liquid for a charge transport layer:

| | Parts by Weight |
|---|---|
| Polycarbonate resin "C-1400" (Trademark), made by Teijin Limited. | 100 |
| Charge transporting monomer No. 3 | 90 |
| Silicone oil "KF-50" (Trademark), made by Shinetsu Polymer Co., Ltd. | 1 |
| Dichloromethane | 800 |

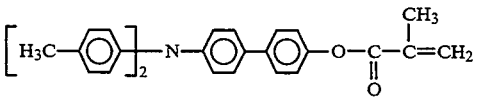

The thus prepared coating liquid was coated on the above prepared charge generation layer by dip coating, and dried at 120° C. for 20 minutes, so that a charge transport layer with a thickness of 25 μm was provided on the charge generation layer. The charge transport layer was then exposed to a high-pressure mercury vapor lamp with an illuminance of 120 W/cm as the cylindrical photoconductor was rotated for 2 minutes.

Thus, an electrophotographic photoconductor No. 1 according to the present invention was obtained.

The thus prepared electrophotographic photoconductor No. 1 according to the present invention was subjected to the electrophotographic property evaluation test using an electrostatic copying sheet testing apparatus as described in Japanese Laid-Open Patent Application 60-100167.

The photoconductor No. 1 was charged in the dark under application of a voltage of −6 kV for 20 seconds as the photoconductor was rotated at 1000 rpm, and the surface potential Vm (volt) of the photoconductor was measured. Then, the electrophotographic photoconductor No. 1 was allowed to stand in the dark for 20 seconds without applying any charge thereto, and the surface potential Vo (volt) of the photoconductor No. 1 was measured. The photoconductor No. 1 was then illuminated by a tungsten lamp with an illuminance of 26 lux with the slit width being adjusted to 6 mm, and the exposure $E_{\frac{1}{2}}$ (lux·sec) and $E_{1/10}$ (lux·sec) required to reduce the initial surface potential Vo to respectively ½ and 1/10 thereof were measured.

The surface potential Vr (volt) of the photoconductor No. 1 was also measured after the application of tungsten light for 20 seconds.

In addition to the above, the photoconductor No. 1 was placed in a commercially available copying machine "FT-4820" (Trademark), made by Ricoh Company, Ltd., and 100,000 copies were made to evaluate the durability of the photoconductor No. 1. In this durability test, the initial potential of a dark portion on the surface of the photoconductor was set to −800 V and the initial potential of a portion to which the light was applied (hereinafter referred to as a light portion) was set to −80 V. The potential of the dark portion (VD) and the potential of the light portion (VL) were measured after making of 100,000 copies.

Furthermore, an abrasion test was conducted to measure the width of wear on the surface of the photoconductor No. 1, using a commercially available tester "Fischerscope Eddy 560" (Trademark), made by Helmut Fischer GmbH+Co.

The results of the above-mentioned tests are given in Tables 4-1 and 4-2.

EXAMPLES 2 TO 11

The procedure for the preparation of the electrophotographic photoconductor No. 1 according to the present invention in Example 1 was repeated except that the charge transporting monomer No. 3 and the polycarbonate resin serving as a binder resin for use in the charge transport layer coating liquid in Example 1 were replaced by the respective charge transporting monomers and binder resins as shown in Table 3. Thus, electrophotographic photoconductors No. 2 to No. 11 according to the present invention were obtained.

TABLE 3

| | Charge Transporting Monomer | Binder Resin |
|---|---|---|
| Ex. 2 | No. 9 | No. 2 |
| Ex. 3 | No. 10 | No. 3 |
| Ex. 4 | No. 26 | No. 5 |
| Ex. 5 | No. 42 | No. 7 |
| Ex. 6 | No. 1 | No. 14 |
| Ex. 7 | No. 123 | Copolymer No. 33 (85/15 mol %) |
| Ex. 8 | No. 62 | Copolymer No. 34 (85/15 mol %) |
| Ex. 9 | No. 63 | No. 13 |
| Ex. 10 | No. 3 | ST-MMA copolymer "BR-50" (Trademark) made by Mitsubishi Ravon Engineering Co., Ltd. |
| Ex. 11 | No. 3 | PMMA "BR-88" (Trademark) made by Mitsubishi Rayon Engineering Co., Ltd. |

St: styrene, MMA: methyl methacrylate, PMMA: polymethyl methacrylate

Using each of the above obtained electrophotographic photoconductors No. 2 to No. 11, the electrophotographic property evaluation test, the abrasion test and the durability test were conducted in the same manner as described in Example 1. The results are shown in Tables 4-1 and 4-2.

TABLE 4-1

| | Vm (V) | Vo (V) | E1/2 lux · sec | E1/10 lux · sec | Vr (V) | Depth of Wear (μm) |
|---|---|---|---|---|---|---|
| Ex. 1 | −1320 | −1060 | 0.82 | 2.35 | −5 | 0.8 |
| Ex. 2 | −1280 | −1005 | 0.78 | 2.23 | −5 | 1.2 |
| Ex. 3 | −1240 | −1000 | 0.77 | 2.16 | −5 | 1.2 |
| Ex. 4 | −1440 | −1180 | 1.47 | 3.40 | −6 | 1.4 |
| Ex. 6 | −1220 | −980 | 0.74 | 2.18 | 0 | 0.8 |
| Ex. 7 | −1180 | −1020 | 1.13 | 3.08 | −7 | 1.0 |
| Ex. 8 | −1250 | −970 | 1.08 | 2.96 | −8 | 0.9 |
| Ex. 9 | −1220 | −960 | 1.03 | 2.94 | −8 | 0.8 |
| Ex. 10 | −1360 | −1200 | 1.48 | 3.52 | −10 | 6.9 |
| Ex. 11 | −1390 | −1240 | 1.56 | 3.78 | −10 | 4.8 |

TABLE 4-2

| | VD (V) | VL (V) |
|---|---|---|
| Ex. 1 | −780 | −90 |
| Ex. 2 | −770 | −95 |
| Ex. 3 | −790 | −95 |
| Ex. 4 | −780 | −95 |
| Ex. 5 | −800 | −100 |
| Ex. 6 | −780 | −90 |
| Ex. 7 | −790 | −95 |
| Ex. 8 | −800 | −85 |
| Ex. 9 | −780 | −90 |
| Ex. 10 | −800 | −100 |
| Ex. 11 | −000 | −100 |

COMPARATIVE EXAMPLE 1

An intermediate layer and a charge generation layer were successively formed on a substrate in the same manner as in Example 1.

Formation of Charge Transport Layer

The following components were mixed and dispersed to prepare a coating liquid for a charge transport layer:

| | Parts by Weight |
|---|---|
| Polycarbonate regin "C-1400" (Trademark), made by Teijin Limited. | 100 |
| Charge transporting material: | |

-continued

| | Parts by Weight |
|---|---|
| 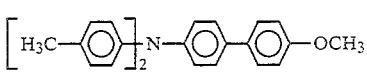 | 90 |
| Silicone oil "KF-50" (Trademark), made by Shinetsu Polymer Co., Ltd. | 1 |
| Dichloromethane | 800 |

The thus prepared liquid was coated on the above prepared charge generation layer by dip coating, and dried at 120° C. for 20 minutes, so that a charge transport layer with a thickness of 23 μm was provided on the charge generation layer.

Thus, a comparative electrophotographic photoconductor No. 1 was obtained.

Using the above obtained comparative electrophotographic photoconductor No. 1, the electrophotographic property evaluation test, the abrasion test and the durability test were conducted in the same manner as described in Example 1. The results are shown in Tables 6-1 and 6-2.

COMPARATIVE EXAMPLES 2 TO 4

The procedure for the preparation of the comparative electrophotographic photoconductor No. 1 in Comparative Example 1 was repeated except that the polycarbonate resin serving as a binder resin for use in the charge transport layer coating liquid in Comparative Example 1 was replaced by the respective binder resins as shown in Table 5. Thus, comparative electrophotographic photoconductors No. 2 to No. 4 were obtained.

TABLE 5

| | Binder Resin |
|---|---|
| Comp. Ex. 1 | No. 1 |
| Comp. Ex. 2 | No. 13 |
| Comp. Ex. 3 | ST-MMA copolymer "BR-50" (Trademark) made by Mitsubishi, Rayon Engineering Co., Ltd. |
| Comp. Ex. 4 | PMMA "BR-88" (Trademark) made by Mitsubishi Rayon Engineering Co., Ltd. |

St: styrene, MMA: methyl methacrylate, PMMA: polymethyl methacrylate

Using each of the above obtained comparative electrophotographic photoconductors No. 2 to No. 4, the electrophotographic property evaluation test, the abrasion test and the durability test were conducted in the same manner as described in Example 1. The results are shown in Tables 6-1 and 6-2.

TABLE 6-1

| | Vm (V) | Vo (V) | E1/2 lux · sec | E1/10 lux · sec | Vr (V) | Depth of Wear (μm) |
|---|---|---|---|---|---|---|
| Comp. Ex. 1 | −1450 | −1380 | 1.09 | 2.13 | 0 | 7.8 |
| Comp. Ex. 2 | −1350 | −1180 | 0.90 | 1.98 | 0 | 4.2 |
| Comp. Ex. 3 | −1380 | −1240 | 1.76 | 3.86 | −10 | 17.2 |
| Comp. Ex. 4 | −1410 | −1280 | 1.89 | 4.02 | −10 | 15.6 |

TABLE 6-2

| | VD (V) | VL (V) |
|---|---|---|
| Comp. Ex. 1 | −700 | −150 |
| Comp. Ex. 2 | −720 | −120 |
| Comp. Ex. 3 | −660 | −250 |
| Comp. Ex. 4 | −680 | −200 |

As a result of the above-mentioned tests, clear images were obtained after making of 100,000 copies as well as at the initial stage when the electrophotographic photoconductors No. 1 to No. 9 were employed.

When the photoconductor No. 10 according to the present invention obtained in Example 10 was employed, the toner deposition was slightly observed on the background of the photoconductor and white and black stripes appeared in the half-tone images after making of 100,000 copies. When the photoconductor No. 11 according to the present invention obtained in Example 11 was employed, the toner deposition on the background was observed at a normal developing bias voltage. However, the toner deposition on the background was eliminated by controlling the developing bias voltage.

Although the photoconductors No. 10 and No. 11 according to the present invention showed the above-mentioned drawbacks, the depth of wear of the photoconductors No. 10 and No. 11 was drastically decreased as compared with the comparative photoconductors No. 3 and 4 comprising the same binder resins respectively as those in photoconductors No. 10 and No. 11 according to the present invention. Namely, the wear resistance of the photoconductors No. 10 and No. 11 according to the present invention was improved since the charge transporting monomer No. 3 of formula (I) for use in the present invention was employed.

When the comparative photoconductor No. 1 obtained in Comparative Example 1 was employed, the toner deposition was observed on the background of the photoconductor and white and black stripes appeared in the half-tone images after making of 100,000 copies. The comparative photoconductor No. 2 obtained in Comparative Example 2 was poor in the electric characteristics. When the comparative photoconductors No. 3 and No. 4 were employed, the toner deposition on the background was observed after making of 40,000 to 50,000 copies. After that, the toner deposition on the background was not eliminated even by controlling the developing bias voltage.

EXAMPLE 12

Formation of Charge Transport Layer

The following components were mixed to prepare a coating liquid for a charge transport layer:

| | Parts by Weight |
|---|---|
| Polycarbonate resin "C-1400" (Trademark), made by Teijin Limited. | 100 |
| Charge transporting material of the following formula: 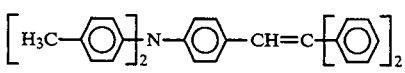 | 90 |
| Silicone oil "KF-50" (Trademark), made by Shinetsu Polymer Co., Ltd. | 1 |
| Dichloromethane | 1000 |

The thus prepared liquid was coated on an aluminum cylinder with a diameter of 80 mm and a length of 340 mm serving as an electroconductive substrate by dip coating, and dried at 120° C. for 20 minutes, so that a charge transport layer with a thickness of 20 μm was formed on the electroconductive substrate.

Formation of Charge Generation Layer

A mixture of the following components was pulverized and dispersed in a ball mill for 72 hours:

| | Parts by Weight |
|---|---|
| Charge generating material: 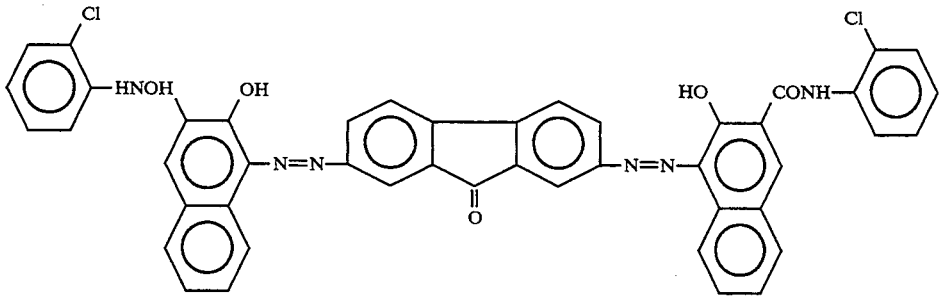 | 22 |
| Polyethylene glycol monostearate "Ionet 400MS" (Trademark), made by Sanyo Chemical Industries, Ltd. | 2 |
| Cyclohexanone | 440 |

With the addition of 400 parts by weight of methyl ethyl ketone to the above dispersion, the mixture was further dispersed for 3 hours to prepare a mill base. Twenty parts by weight of the above-mentioned mill base wars diluted with a solution comprising 20 parts by weight of a mixed solvent of cyclohexanone and methyl ethyl ketone at a mixing ratio by weight of 1:1, 2 parts by weight of the charge transporting monomer No. 32, 2 parts by weight of polycarbonate resin No. 11 in Table 1 and one part by weight of a commercially available 2,2-bis(4,4-di-t-butyl peroxycyclohexyl)propane "Perkadox 12-XL25" (Trademark) made by Kayaku Akzo Co., Ltd. Thus, a coating liquid for a charge generation layer was obtained. The thus obtained charge generation layer coating liquid was coated on the above prepared charge transport layer by spray coating and dried at 150° C. for 30 minutes, so that a charge generation layer with a thickness of 3 μm was provided on the charge transport layer.

Thus, an electrophotographic photoconductor No. 12 according to the present invention was obtained.

EXAMPLES 13 TO 15

The procedure for the preparation of the electrophotographic photoconductor No. 12 according to the present invention in Example 12 was repeated except that the charge generating material and the polycarbonate resin No. 11 serving as a binder resin for use in the charge generation layer coating liquid in Example 12 were replaced by the respective charge generating materials and binder resins as shown in Table 7. Thus, electrophotographic photoconductors No. 13 to No. 15 according to the present invention were obtained.

TABLE 7

| | Binder Resin (shown in Table 1 or 2) | Charge Generating Material |
|---|---|---|
| Ex. 13 | No. 30 | C.I. No. 59300 Vat Orange 3 |
| Ex. 14 | No. 12 | 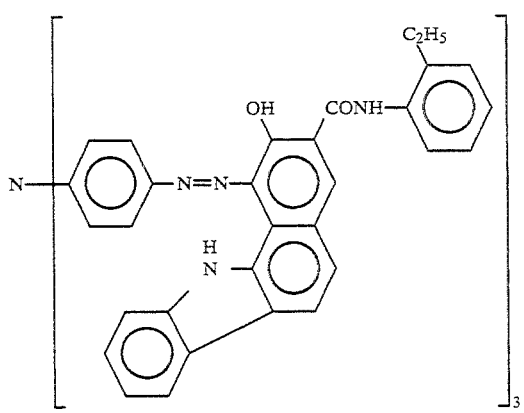 |
| Ex. 15 | No. 39 | Titanyl phthalocyanine with a main peak specified by Bragg angle (2θ) of 27.2° in X-ray diffraction pattern |

COMPARATIVE EXAMPLE 5

A charge transport layer was formed on a substrate in the same manner as in Example 12.

Formation of Charge Generation Layer

Twenty parts by weight of the same mill base as prepared in Example 12 were diluted with a solution comprising 20 parts by weight of a mixed solvent of cyclohexanone and methyl ethyl ketone at a mixing ratio by weight of 1 : 1, 2 parts by weight of the same charge transporting material as employed in Comparative Example 1, and 2 parts by weight of polycarbonate resin No. 11 in Table 1. Thus, a coating liquid for a charge generation layer was obtained. The thus obtained charge generation layer coating liquid was coated on the above prepared charge transport layer by spray coating and dried at 150° C. for 30 minutes, so that a charge generation layer with a thickness of 3 μm was provided on the charge transport layer.

Thus, a comparative electrophotographic photoconductor No. 5 was obtained.

Each of the thus prepared electrophotographic photoconductors No. 12 to No. 15 and comparative electrophotographic photoconductor No. 5 was subjected to the electrophotographic property evaluation test in the same manner as in Example 1 except that a voltage of +6 kV was applied to the surface of each photoconductor to measure the initial surface potential Vm (volt).

In addition to the above, the photoconductor was placed in a commercially available copying machine "FT-6550" (Trademark), made by Ricoh Company, Ltd., and 50,000 copies were made to evaluate the durability of each photoconductor. In this durability test, the initial potential of a dark portion on the surface of the photoconductor was set to +800 V and the initial potential of a light portion was set to +80 V. The potential of the dark portion (VD) and the potential of the light portion were measured after making of 50,000 copies.

Furthermore, an abrasion test was conducted in the same manner as in Example 1.

The results of the above-mentioned tests are given in Tables 8-1 and 8-2.

TABLE 8-1

| | Vm (V) | Vo (V) | E1/2 lux · sec | E1/10 lux · sec | Vr (V) | Depth of Wear (μm) |
|---|---|---|---|---|---|---|
| Ex. 12 | 1210 | 1020 | 1.12 | 2.62 | 10 | 0.6 |
| Ex. 13 | 1420 | 1280 | 2.34 | 4.35 | 20 | 0.4 |
| Ex. 14 | 1130 | 890 | 1.03 | 2.53 | 15 | 0.8 |
| Ex. 15 | 1010 | 720 | 0.63 | 1.68 | 30 | 0.3 |
| Comp. Ex. 5 | 1280 | 1100 | 1.08 | 2.53 | 10 | 1.8 |

TABLE 8-2

| | VD (V) | VL (V) |
|---|---|---|
| Ex. 12 | 800 | 85 |
| Ex. 13 | 800 | 90 |
| Ex. 14 | 780 | 85 |
| Ex. 15 | 770 | 80 |
| Comp. Ex. 5 | 780 | 85 |

As a result of the tests, clear images were obtained at the initial stage and after making of 50,000 copies when the photoconductors No. 12 to No. 15 according to the present invention were employed. On the other hand, there were several scratches reaching the charge transport layer of the comparative photoconductor No. 5, and black stripes therefore appeared in the obtained images. As a result, the image density of the obtained images became uneven.

EXAMPLE 16

Formation of Photoconductive Layer

To 10 parts by weight of the same mill base containing the charge generating material as prepared in Example 12, 10 parts by weight of a charge transporting monomer No. 3, 12 parts by weight of a binder resin No. 42 in Table 2, 5 parts by weight of a commercially available 2,2-bis(4,4-di-t-butyl peroxycyclohexyl)propane "Perkadox 12-XL25" (Trademark) made by Kayaku Akzo Co., Ltd., 10 parts by weight of cyclohexanone and 10 parts by weight of methyl ethyl ketone to prepare a coating liquid for a photoconductive layer. The thus obtained photoconductive layer coating liquid was coated on an aluminum cylinder with a diameter of 80 mm and a length of 340 mm serving as an electroconductive substrate by spray coating, and dried and cured at 150° C. for 30 minutes, so that a single-layered photoconductive layer with a thickness of 30 μm was provided on the electroconductive substrate.

Thus, an electrophotographic photoconductor No. 16 according to the present invention was obtained.

The thus prepared electrophotographic photoconductor No. 16 was subjected to the electrophotographic property evaluation test in the same manner as in Example 12. The results are as follows:

Vm (V): 1240
Vo (V): 1000
$E_{\frac{1}{2}}$ (lux·sec): 1.06
$E_{1/10}$ (lux·sec): 2.56
Vr (V): 10

In addition to the above, the photoconductor No. 16 according to the present invention was placed in a commercially available copying machine "FT-6550" (Trademark), made by Ricoh Company, Ltd., and 10,000 copies were made to evaluate the durability of the photoconductor No. 16. As a result, there was no wear on the surface of the photoconductor No. 16, and clear images were obtained without the toner deposition on the background of the photoconductor which resulted from the deterioration of photosensitivity.

EXAMPLE 17

An intermediate layer and a charge generation layer were successively provided on an aluminum cylinder with a diameter of 80 mm and a length of 340 mm in the same manner as in Example 1.

Formation of Lower Charge Transport Layer

The same charge transport layer coating liquid as employed in Example 12 was coated on the above prepared charge generation layer and dried in the same manner as in Example 12, so that a lower charge transport layer with a thickness of 20 μm was provided on the charge generation layer.

Formation of Top Charge Transport Layer

A mixture of 1 part by weight of a binder resin No. 39 in Table 2, one part by weight of a charge transporting monomer No. 63 and 0.2 parts by weight of a commercially available 2,2-bis(4,4-di-t-butyl peroxycyclohexyl)propane "Perkadox 12-XL25" (Trademark) made by Kayaku Akzo Co., Ltd. was dissolved in a mixed solvent of tetrahydrofuran and cyclohexanone at a mixing ratio by weight of 1:1, so that a 6% solution was obtained. The thus obtained coating liquid for a top charge transport layer was coated on the above prepared lower charge transport layer by spray coating, and dried and cured at 150° C. for 30 minutes, so that a top charge transport layer with a thickness of 3 μm was provided on the lower charge transport layer.

Thus, an electrophotographic photoconductor No. 17 according to the present invention was obtained.

The thus prepared electrophotographic photoconductor No. 17 was subjected to the electrophotographic property evaluation test in the same manner as in Example 12. The results are as follows:

Vm (V): 1380
Vo (V): 1180
$E_{\frac{1}{2}}$ (lux·sec): 0.8
$E_{1/10}$ (lux·sec): 1.6
Vr (V): 10

In addition to the above, the photoconductor No. 17 according to the present invention was placed in a commercially available copying machine "FT-6550" (Trademark), made by Ricoh Company, Ltd., and 10,000 copies were made to evaluate the durability of the photoconductor No. 17. As a result, there was no wear on the surface of the photoconductor No. 17, and any abnormal images caused by the appearance of white and black stripes and the occurrence of the filming phenomenon were not observed.

As previously mentioned, a photoconductive layer of the electrophotographic photoconductor according to the present invention comprises an interpenetrating polymer network prepared by polymerizing a composition comprising a carbon-carbon double-bond-containing charge transporting monomer of formula (I), (II) or (III) and a binder resin by the application of heat or light thereto, so that the wear resistance of the obtained photoconductor is improved, and high photosensitivity and high durability can be ensured.

What is claimed is:

1. An electrophotographic photoconductor comprising an electroconductive substrate and a photoconductive layer formed thereon, wherein said photoconductive layer comprises a charge generating material and an interpenetrating polymer network prepared by polymerizing a composition comprising a binder resin and at least one polymerizable carbon-carbon double-bond-containing charge transporting monomer selected from the group consisting of monomers of formulas (I), (II) and (III) by the application of light or heat thereto:

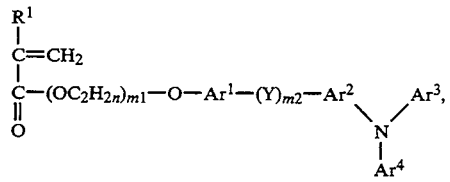

(I)

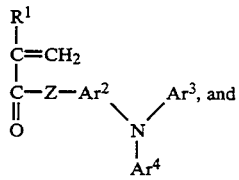

(II)

-continued

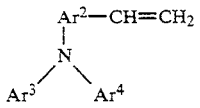

(III)

wherein $R^1$ is hydrogen or methyl group; $Ar^1$ and $Ar^2$ each is a bivalent aromatic hydrocarbon group which may have a substituent such as hydrogen, fluorine, chlorine, bromine, iodine, or a straight-chain or branched alkyl group having 1 to 4 carbon atoms which may have a substituent such as fluorine, cyano group or phenyl group; $Ar^3$ and $Ar^4$ each is a monovalent aromatic hydrocarbon group which may have a substituent such as hydrogen, fluorine, chlorine, bromine, iodine, or a straight-chain or branched alkyl group having 1 to 4 carbon atoms which may have a substituent such as fluorine, cyano group or phenyl group; Y is $—C_nH_{2n}—$, —CH=CH—, or $—CAr^1=CH—$; Z id —O—, $—OC_nH_{2n}—$, or $—OC_nH_{2n}O—$; n is an integer from 1 to 10; and m1 and m2 is an integer of 0 or 1.

2. The electrophotographic photoconductor as claimed in claim 1, wherein said binder resin is a homopolymer or copolymer comprising a repeat unit represented by formula (IV):

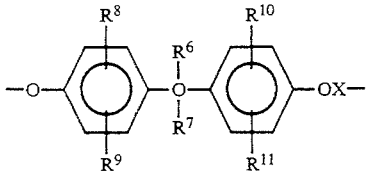

(IV)

wherein $R^6$ and $R^7$ each is hydrogen, an alkyl group having 1 to 10 carbon atoms, or an aryl group, and $R^6$ and R7 may form a cycloalkyl group in combination; $R^8$, $R^9$, $R^{10}$ and $R^{11}$ each is hydrogen, an alkyl group having 1 to 5 carbon atoms, an aryl group, a cycloalkyl group or a halogen; and X is

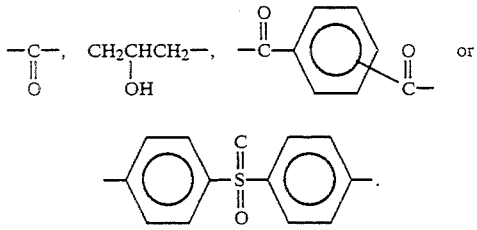

3. The electrophotographic photoconductor as claimed in claim 1, wherein said binder resin is a vinyl homopolymer or copolymer resin comprising a repeat unit represented by formula (V):

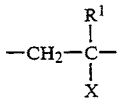

(V)

wherein $R^1$ is hydrogen or methyl group; and X is an aryl group or $COOR^2$, in which $R^2$ is an alkyl group having 1 to 3 carbon atoms or an aryl group.

4. The electrophotographic photoconductor as claimed in claim 1, wherein the amount ratio by weight of said charge transporting monomer to that of said binder resin in said composition is in the range from 10:5 to 10:50.

5. The electrophotographic photoconductor as claimed in claim 1, wherein said photoconductive layer comprises a charge generation layer comprising said charge generating material, and a charge transport layer formed on said charge generation layer, comprising said interpenetrating polymer network prepared by polymerizing said composition comprising said carbon-carbon double-bond-containing charge transporting monomer and said binder resin.

6. The electrophotographic photoconductor as claimed in claim 5, further comprising an intermediate layer which is provided between said electroconductive substrate and said charge generation layer.

7. The electrophotographic photoconductor as claimed in claim 5, wherein said binder resin for use in said interpenetrating polymer network is said homopolymer or copolymer comprising a repeat unit represented by formula (IV):

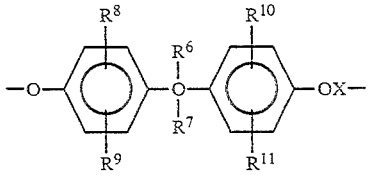

(IV)

wherein $R^6$ and $R^7$ each is hydrogen, an alkyl group having 1 to 10 carbon atoms, or an aryl group, and $R^6$ and R7 may form a cycloalkyl group in combination; $R^8$, $R^9$, $R^{10}$ and $R^{11}$ each is hydrogen, an alkyl group having 1 to 5 carbon atoms, an aryl group, a cycloalkyl group or a halogen; and X is

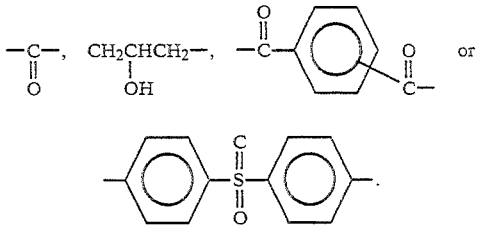

8. The electrophotographic photoconductor as claimed in claim 5, wherein said binder resin for use in said interpenetrating polymer network is said vinyl homopolymer or copolymer resin comprising a repeat unit represented by formula (V):

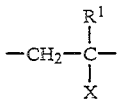

(V)

wherein $R^1$ is hydrogen or methyl group; and X is an aryl group or $COOR^2$, in which $R^2$ is an alkyl group having 1 to 3 carbon atoms or an aryl group.

9. The electrophotographic photoconductor as claimed in claim 1, wherein said photoconductive layer comprises a charge transport layer comprising a charge transporting material, and a charge generation layer formed on said charge transport layer, comprising an interpenetrating polymer network prepared by polymerizing a composition comprising said charge generating material, said carbon-carbon double-bond-containing charge transporting monomer and said binder resin.

10. The electrophotographic photoconductor as claimed in claim 9, wherein said binder resin for use in said interpenetrating polymer network is said homopolymer or copolymer comprising a repeat unit represented by formula (IV):

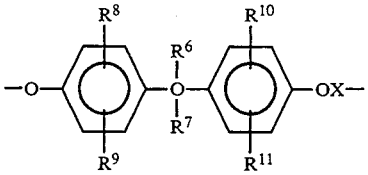

(IV)

wherein $R^6$ and $R^7$ each is hydrogen, an alkyl group having 1 to 10 carbon atoms, or an aryl group, and $R^6$ and R7 may form a cycloalkyl group in combination; $R^8$, $R^9$, $R^{10}$ and $R^{11}$ each is hydrogen, an alkyl group having 1 to 5 carbon atoms, an aryl group, a cycloalkyl group or a halogen; and X is

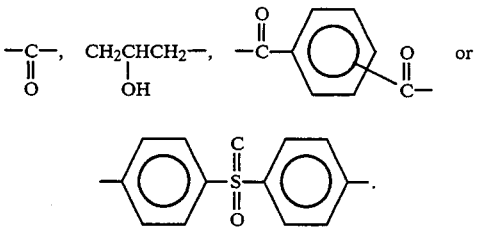

11. The electrophotographic photoconductor as claimed in claim 9, wherein said binder resin for use in said interpenetrating polymer network is said vinyl homopolymer or copolymer resin comprising a repeat unit represented by formula (V):

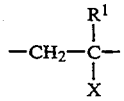

(V)

wherein $R^1$ is hydrogen or methyl group; and X is an aryl group or $COOR^2$, in which $R^2$ is an alkyl group having 1 to 3 carbon atoms or an aryl group.

12. The electrophotographic photoconductor as claimed in claim 9, wherein the amount ratio by weight of said charge transporting monomer to that of said binder resin to that of said charge generating material in said composition for said interpenetrating polymer network is 10:(7 to 30):(2 to 10).

13. The electrophotographic photoconductor as claimed in claim 1, wherein said composition for use in said interpenetrating polymer network comprises said charge generating material.

14. The electrophotographic photoconductor as claimed in claim 13, wherein said binder resin for use in said interpenetrating polymer network is said homopolymer or copolymer comprising a repeat unit represented by formula (IV):

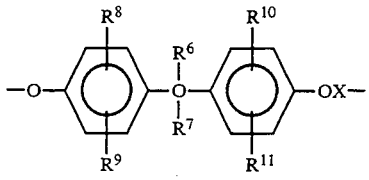

(IV)

wherein $R^6$ and $R^7$ each is hydrogen, an alkyl group having 1 to 10 carbon atoms, or an aryl group, and $R^6$ and R7 may form a cycloalkyl group in combination; $R^8$, $R^9$, $R^{10}$ and $R^{11}$ each is hydrogen, an alkyl group having 1 to 5 carbon atoms, an aryl group, a cycloalkyl group or a halogen; and X is

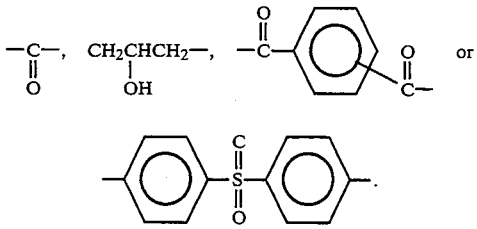

15. The electrophotographic photoconductor as claimed in claim 13, wherein said binder resin for use in said interpenetrating polymer network is said vinyl homopolymer or copolymer resin comprising a repeat unit represented by formula (V):

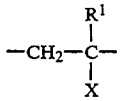

(V)

wherein $R^1$ is hydrogen or methyl group; and X is an aryl group or $COOR^2$, in which $R^2$ is an alkyl group having 1 to 3 carbon atoms or an aryl group.

16. The electrophotographic photoconductor as claimed in claim 13, wherein the amount ratio by weight of said charge transporting monomer to that of said binder resin to that of said charge generating material in said composition is 10:(7 to 30):(2 to 10).

17. The electrophotographic photoconductor as claimed in claim 5, wherein said charge transport layer further comprises a low-molecular-weight charge transporting material.

18. The electrophotographic photoconductor as claimed in claim 17, wherein the amount ratio by weight of said carbon-carbon double-bond-containing charge transporting monomer to that of said low-molecular weight charge transporting material is in the range from (10: 0.1) to (10:10).

19. The electrophotographic photoconductor as claimed in claim 17, wherein said charge transport layer is of a laminated type, comprising a top charge transport layer comprising said interpenetrating polymer network prepared by polymerizing said composition comprising said carbon-carbon double-bond-containing charge transporting monomer and said binder resin.

* * * * *

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 3, line 37, "$CAr^1$-CH-" should read --$CAr^1$=CH--.

Column 3, line 56, "chare" should read --charge--.

Column 7, line 33, formula No. 18

"

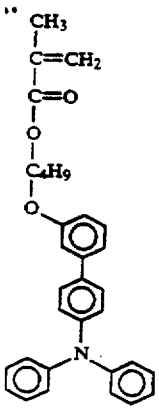

No. 18

"

should read --

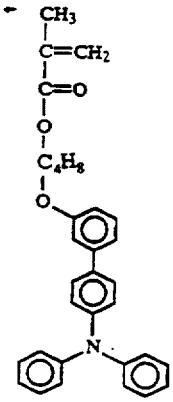

No. 18

--.

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 7, line 55, formula No. 19

" 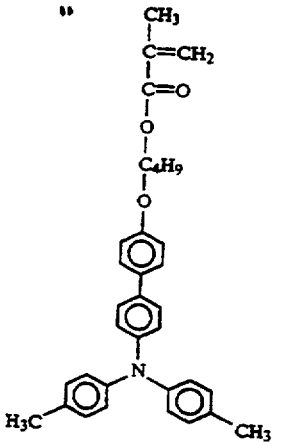

No. 19 "

should read -- 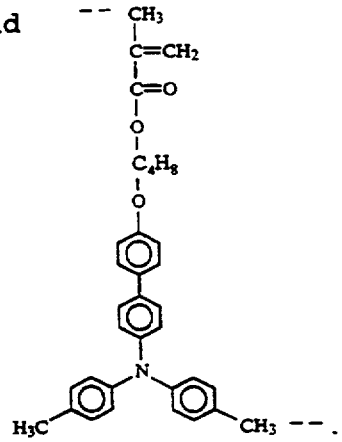

No. 19 --.

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 7, line 60, formula No. 20

"

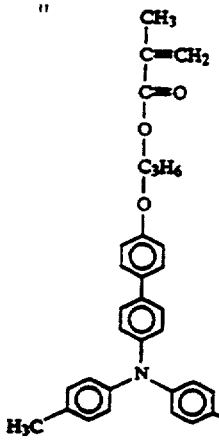

No. 20 "

should read

--

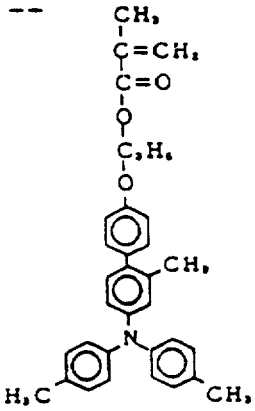

No. 20 --.

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-identified patent and that said Letters Patent is hereby corrected as shown below:

Column 8, line 12, formula No. 22

" 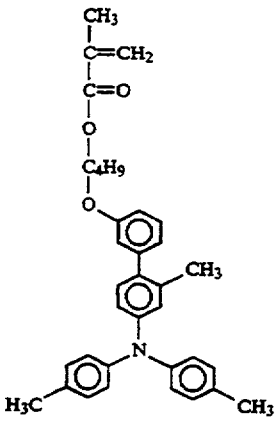

No. 22 "

should read --

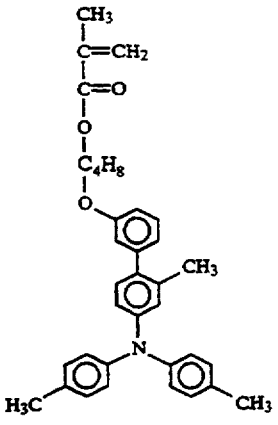

No. 22 --.

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 12, line 54, formula No. 49

" 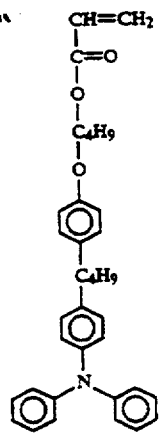 "

No. 49 should read -- 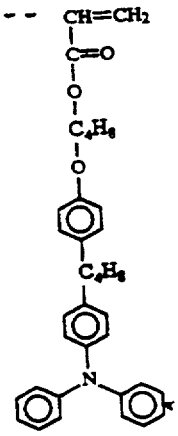 --.

No. 49

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 12, line 54, formula No. 50

" 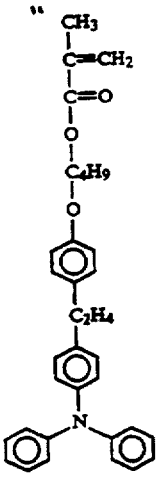

"

No. 50 should read -- 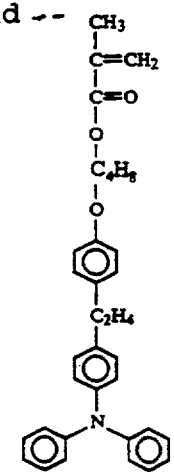

--.

No. 50

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 13, line 16, formula No. 51

"

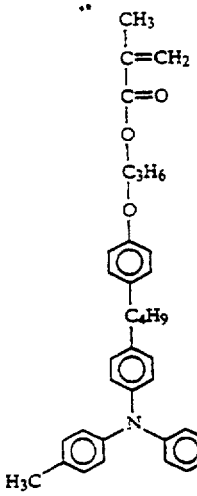

No. 51

"

should read --

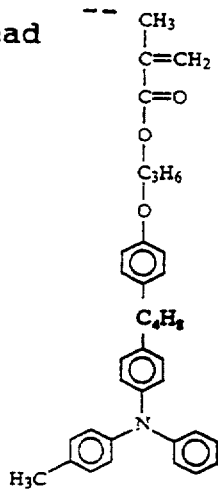

No. 51

-- .

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 13, line 15, formula No. 52

" 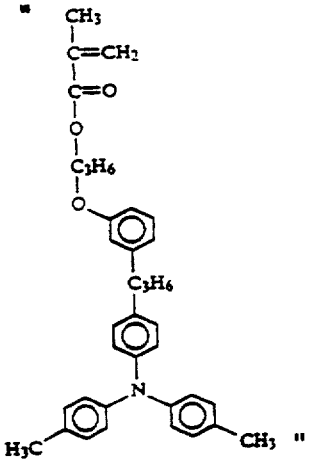 "

No. 52 should read

-- 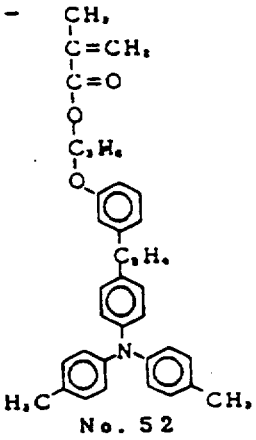 --.

No. 52

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 13, line 37, formula No. 53

" 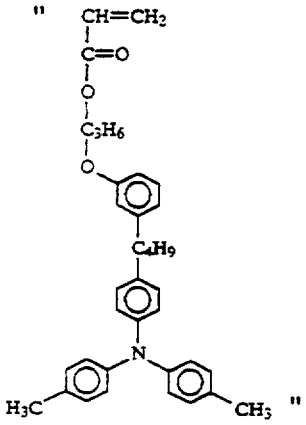

No. 53 "

should read -- 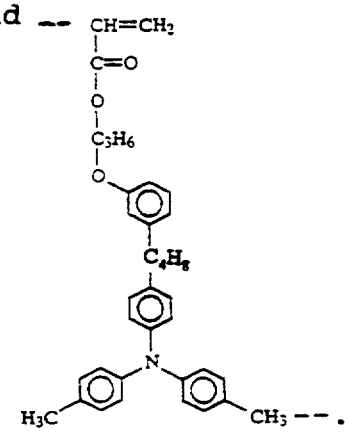

No. 53 -- .

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 14, line 11, formula No. 57

" 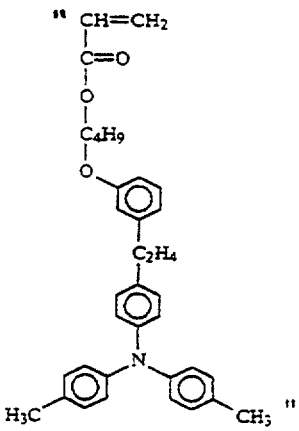

No. 57 "

should read -- 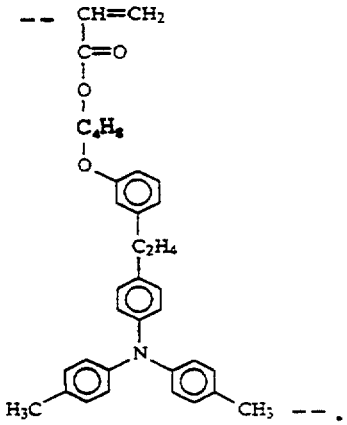

No. 57 -- .

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 14, line 11, formula No. 58

" 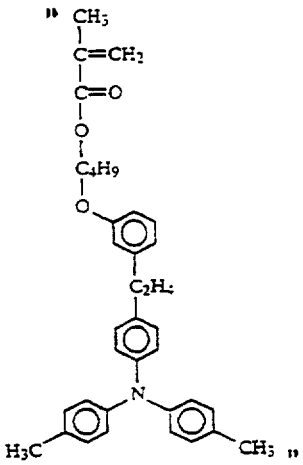

No. 58 "

should read

-- 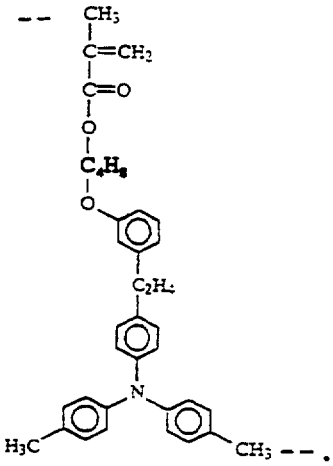

No. 58 -- .

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 14, line 37, formula No. 59

" 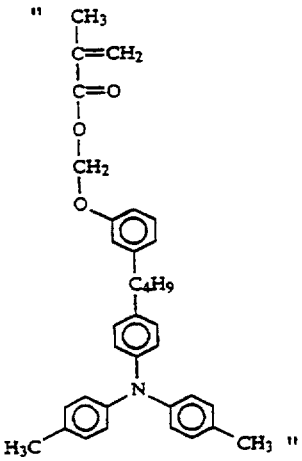 "

No. 59 should read --

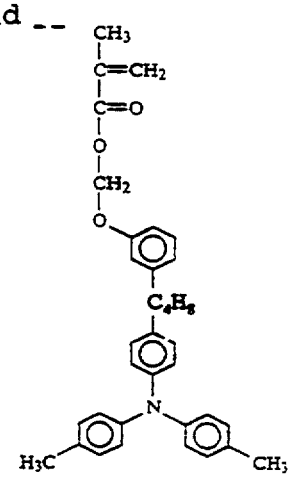 --.

No. 59

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 17, line 63, formula No. 79

"

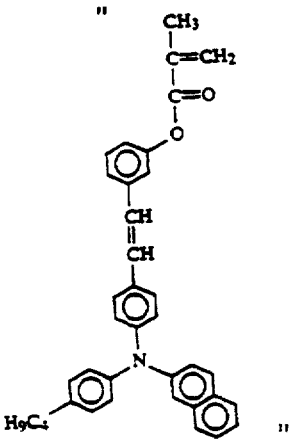

No. 79

"

should read

-- 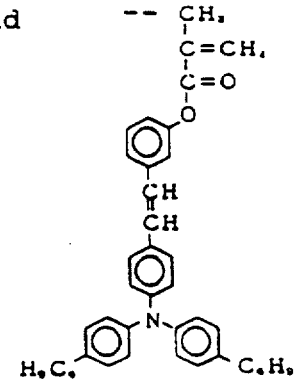

No. 79

--.

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 24, line 43, formula No. 109

" 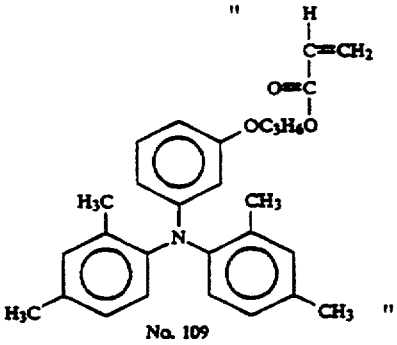

No. 109 "

should read -- 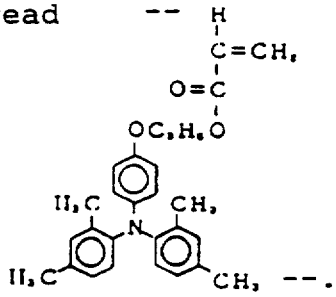

No. 109 --.

Column 29, line 30, "R7" should read --$R^7$--.

Column 40, line 67, "s-silicon" should read --α-silicon--.

UNITED STATES PATENT AND TRADEMARK OFFICE

CERTIFICATE OF CORRECTION

PATENT NO. : 5,427,880

DATED : June 27, 1995

INVENTOR(S) : HIROSHI TAMURA ET AL

It is certified that error appears in the above-indentified patent and that said Letters Patent is hereby corrected as shown below:

Column 45, line 13, "Ravon" should read --Rayon--.

Column 45, line 33, between Ex. 4 and Ex. 6, insert --Ex. 5 -1380 -1160 1.33 2.86 -6 2.9--.

Column 45, line 50, "000" should read --800--.

Column 48, line 58, "wars" should read --were--.

Column 53, line 19, "id" should read --is--.

Column 53, line 37, "R7" should read --$R^7$--.

Column 54, line 33, "R7" should read --$R^7$--.

Column 55, line 19, "R7" should read --$R^7$--.

Column 56, line 12, "R7" should read --$R^7$--.

Signed and Sealed this

Twenty-fourth Day of September, 1996

*Attest:*

Bruce Lehman

BRUCE LEHMAN

*Attesting Officer*

*Commissioner of Patents and Trademarks*